US008897673B2

(12) United States Patent
Lee et al.

(10) Patent No.: US 8,897,673 B2
(45) Date of Patent: Nov. 25, 2014

(54) PHOTOSENSITIVE DRUM ASSEMBLY AND PROCESS CARTRIDGE HAVING THE SAME

(71) Applicants: Baiksan OPC Co., Ltd., Chungcheongbuk-do (KR); Jang Soon Park, Gyeonggi-do (KR)

(72) Inventors: Bom Jin Lee, Chungcheongbuk-do (KR); Chang Rae Seong, Chungcheongbuk-do (KR); Jang Soon Park, Gyeonggi-do (KR)

(73) Assignees: Jang Soon Park, Gyeonggi-Do (KR); Baiksan OPC Co., Ltd., Chungcheongbuk-Do (KR)

( * ) Notice: Subject to any disclaimer, the term of this patent is extended or adjusted under 35 U.S.C. 154(b) by 58 days.

(21) Appl. No.: 13/670,811

(22) Filed: Nov. 7, 2012

(65) Prior Publication Data

US 2013/0236211 A1 Sep. 12, 2013

(30) Foreign Application Priority Data

Mar. 9, 2012 (KR) ..... 10-2012-0024686
Mar. 19, 2012 (KR) ..... 10-2012-0027997
Jun. 15, 2012 (KR) ..... 10-2012-0064156

(51) Int. Cl.
*G03G 15/00* (2006.01)

(52) U.S. Cl.
CPC ..... *G03G 15/757* (2013.01)
USPC ..... 399/167; 399/111

(58) Field of Classification Search
CPC ..... G03G 15/757
USPC ..... 399/167
See application file for complete search history.

(56) References Cited

U.S. PATENT DOCUMENTS

| | | | | |
|---|---|---|---|---|
| 5,903,803 | A * | 5/1999 | Kawai et al. | 399/116 |
| 6,400,914 | B1 * | 6/2002 | Noda et al. | 399/90 |
| 6,501,927 | B1 * | 12/2002 | Watanabe et al. | 399/117 |
| 6,892,042 | B2 * | 5/2005 | Jang et al. | 399/167 |
| 7,537,410 | B2 * | 5/2009 | Parisi et al. | 403/383 |
| 7,813,676 | B2 * | 10/2010 | Huck et al. | 399/167 |
| 7,991,324 | B2 * | 8/2011 | Takagi | 399/117 |

(Continued)

FOREIGN PATENT DOCUMENTS

| | | |
|---|---|---|
| JP | 10-153942 | 6/1998 |
| JP | 2001-345909 | 11/2001 |

(Continued)

*Primary Examiner* — Clayton E Laballe
*Assistant Examiner* — Trevor J Bervik
(74) *Attorney, Agent, or Firm* — Stuart H. Mayer; Mayer & Williams

(57) ABSTRACT

A photosensitive drum assembly and a process cartridge and a process cartridge having an improved structure in which a protrusion for receiving a driving force transmitted from a main body of an image forming apparatus may not be easily worn or damaged. The photosensitive drum assembly that is capable of being combined with a driving shaft including a twisted hole with a non-circular cross-section having a plurality of corners, includes: a support disposed at one side of the photosensitive drum; and an insertion body disposed at one side of the support and including a plurality of protrusions that are capable of being inserted in the twisted hole, wherein at least portions of each of the plurality of protrusions based on a cross-section of each protrusion that is perpendicular to the driving shaft, closely contacts two side surfaces of the twisted hole that constitute one of the plurality of corners of the twisted hole, respectively.

20 Claims, 17 Drawing Sheets

(56) References Cited

U.S. PATENT DOCUMENTS

| | | | | |
|---|---|---|---|---|
| 8,628,269 | B2 * | 1/2014 | Fan | 403/383 |
| 2010/0196047 | A1 * | 8/2010 | Jin | 399/111 |
| 2010/0303501 | A1 * | 12/2010 | Tsui | 399/167 |

FOREIGN PATENT DOCUMENTS

| | | | |
|---|---|---|---|
| JP | 2005-107413 | | 4/2005 |
| JP | 2005107413 | A * | 4/2005 |
| KR | 10200030026641 | | 4/2003 |

* cited by examiner

PHOTOSENSITIVE DRUM ASSEMBLY AND PROCESS CARTRIDGE HAVING THE SAME

CROSS-REFERENCE TO RELATED PATENT APPLICATION

This application claims the benefit of Korean Patent Application No. 10-2012-0024686, filed on Mar. 9, 2012, No. 10-2012-0027997 filed on Mar. 9, 2012, No. 10-2012-0064156, filed on Jun. 15, 2012, in the Korean Intellectual Property Office, the disclosure of which is incorporated herein in its entirety by reference.

BACKGROUND OF THE INVENTION

1. Field of the Invention

The present invention relates to a photosensitive drum assembly and a process cartridge, and more particularly, to a photosensitive drum assembly and a process cartridge having an improved structure in which a driving force transmitted from a main body of an image forming apparatus is received.

2. Description of the Related Art

Image forming apparatuses are apparatuses that print letters or images on a recording medium, such as paper, or the like. Examples of image forming apparatuses include a copy machine, a laser printer, a light emitting diode (LED) printer, a facsimile, and the like.

Generally, image forming apparatuses include a cartridge that includes toner and records letters or images to be printed on a recording medium, such as paper, or the like. The cartridge is generally attached to or detached from the image forming apparatus so as to replace toner.

FIG. 1 is a schematic view of a structure of an image forming apparatus according to the related art, FIG. 2 is a perspective view of an appearance of a process cartridge 2 of the image forming apparatus illustrated in FIG. 1, and FIG. 3 is a cross-sectional view of a photosensitive drum 110 of the process cartridge 2 of FIG. 1 and peripheral elements of the process cartridge 2.

Referring to FIGS. 1 and 2, the image forming apparatus according to the related art may include the process cartridge 2 that stores toner and supplies the toner to a recording medium 88. The image forming apparatus enables a plurality of rollers 73, 74, 75, 76, and 77 installed at a main body 1 of the image forming apparatus to rotate, supplies the recording medium 88, such as paper, or the like, to a direction indicated by reference numeral 88*s*, simultaneously transmits data, such as an image to be printed, or the like, to the process cartridge 2, and transfers a predetermined amount of the toner stored in a toner storing container 28 onto the recording medium 88 via a photosensitive drum 110 installed at the process cartridge 2, thereby printing a desired image on the recoding medium 88.

To this end, the process cartridge 2 may include the photosensitive drum 110, a cleaning unit, a exposure unit, a developing unit, and the like. The process cartridge 2 may operate in such a way that, if charges are accumulated on the photosensitive drum 110, photosensitization occurs in the photosensitive drum 110, the toner is fused on a photosensitized portion of the photosensitive drum 110, is transferred onto the recording medium 88 and is fixed on the recording medium 88 by heating the toner.

The process cartridge 2 is provided to be attached to or detached from the main body 1 of the image forming apparatus, and a drive assembly 20 that is combined with the photosensitive drum 110 when the process cartridge 2 is mounted on the main body 1, is combined with a driving force providing unit provided to the main body 1 so as to receive a rotation driving force. In detail, a protrusion 21 protrudes from an end of the drive assembly 20 so as to receive a rotation force. The protrusion 21 may be combined with elements of the main body 1.

Unexplained reference numeral 49 denotes the case that supports rotation of the photosensitive drum 110 of the process cartridge 2, unexplained reference numeral 30*g* denotes a gear for transmitting a rotation force and that is disposed at an opposite side to the drive assembly 20, unexplained reference numeral 22 denotes a support that protrudes from the drive assembly 20, and unexplained reference numeral 23 denotes a gear formed on an outer circumferential surface of the drive assembly 20.

FIG. 4 is a perspective view of a rotation driving force transmitting structure of an image forming apparatus according to the related art, and FIG. 5 is a cross-sectional view of FIG. 4. In detail, FIGS. 4 and 5 illustrate a rotation driving force transmitting structure of an image forming apparatus that transmits a driving force by using the above-described method and that is disclosed in Korean Patent Registration No. 0258609.

Referring to FIGS. 4 and 5, when a process cartridge 2 is inserted in a main body 1 of the image forming apparatus, a twisted protrusion 21 of a drive assembly 20 that is combined with one side of a photosensitive drum 110 disposed on the process cartridge 2, is inserted in a twisted hole 181 of a driving shaft 180 disposed on the main body 1 of the image forming apparatus. As the driving shaft 180 is rotated by a driving motor installed in the main body 1 of the image forming apparatus, the twisted hole 181 of the driving shaft 180 and the twisted protrusion 21 are combined with each other and are rotated so that a driving force provided by the driving motor may be transmitted to the photosensitive drum 110 and the photosensitive drum 110 may also be rotated.

In this case, the twisted protrusion 21 is in point contact with three parts of an inner side surface of the twisted hole 181 based on a cross-section of the twisted protrusion 21. The twisted protrusion 21 as a whole is in line contact with three parts of the inner side surface of the twisted hole 181, and thus the driving force is transmitted to the twisted protrusion 21.

The driving shaft 180 may include a gear portion 181*g* to which the driving force is transmitted from the driving motor.

However, the above-described related art has the following problems.

Since the driving force is transmitted to the twisted protrusion 21 based on the cross-section of the twisted protrusion 21 due to point contact, stress is concentrated on a small contact point, the speed of abrasion increases, the contact point is easily worn or damaged, and there is a limitation in performing precise performance during an expected life span of the process cartridge 2.

In detail, in a twisted combination coupling disclosed in Korean Patent Registration No. 0258609, since the twisted protrusion 21 has a complementary shape to the twisted hole 181 and a smaller size than that of the twisted hole 181, a gap is formed between the twisted protrusion 21 and the twisted hole 181 in an angular direction. Thus, when the driving force is transmitted to the twisted protrusion 21, a corner of the twisted protrusion 21 is pressed by the driving force and is closely adhered to one of two side surfaces that constitute one of a plurality of corners of the twisted hole 181 and thus the corner of the twisted protrusion 21 is in point contact with the twisted hole 181. However, when the driving force is not transmitted to the twisted protrusion 21, since the driving force that enables a corner of the twisted protrusion 21 to be pressed and closely adhered to one of two side surfaces of the twisted hole 181 does not exist, the point contact between the twisted protrusion 21 and the twisted hole 181 is released. Since several thousands or several ten thousands times of printing operations are attempted during a life span of the process cartridge 2, a large concentrative load is repeatedly applied to or removed from a local part in which point contact between the twisted protrusion 21 and the twisted hole 181 occurs. Thus, even when a surface pressure that is generated in the point contact portion, does not affect the limit of resisting pressures of materials used in forming the twisted protrusion 21 and the twisted hole 181, a fatigue destruction phenomenon occurs in the point contact portion. In particular, due to the driving force applied to the twisted protrusion 21 in a state where the gap is formed between the twisted protrusion 21 and the twisted hole 181, the instant the corner of the twisted protrusion 21 is rapidly changed into be in point contact with the inner side surface of the twisted hole 181, collision occurs in an area where point contact occurs. Thus, the fatigue destruction phenomenon is accelerated due to this collision.

In addition, when the twisted hole 181 is rotated and is changed from a driving force non-transmission state to a driving force transmission state, first, the corner of the twisted protrusion 21 is in contact with the inner side surface of the twisted hole 181. After the contact has occurred, the twisted hole 181 is further rotated relative to the twisted protrusion 21 and thus the twisted protrusion 21 is pulled out in an axial direction, and if the twisted protrusion 21 is completely pulled out in the axial direction and an axial position of the twisted protrusion 21 is fixed, a series of operations of performing twisted combination between the twisted hole 181 and the twisted protrusion 21 are performed. In this case, a large concentrative load is applied to a local part of the point contact portion of the twisted protrusion 21 and the twisted hole 181, and the point contact portion is moved by friction and thus, abrasion of the point contact portion is very large.

In this way, if the point contact portion between the twisted protrusion 21 and the twisted hole 181 is worn or damaged, a concentric state of the driving shaft 180 and the photosensitive drum 110 cannot be kept, and shake occurs, and when the photosensitive drum 110 is rotated, rotation precision is lowered, and the quality of an image is lowered.

SUMMARY OF THE INVENTION

The present invention provides a photosensitive drum assembly and a process cartridge having an improved structure in which a protrusion for receiving a driving force transmitted from a main body of an image forming apparatus may not be easily worn or damaged.

The present invention also provides a photosensitive drum assembly and a process cartridge having an improved structure in which, even when the process cartridge is used for a long time corresponding to its expected life span, a driving force transmitted from a main body of an image forming apparatus may be stably received so as to enable the image forming apparatus to keep a stable image quality.

However, the problems are exemplary, and the scope of the present invention is not limited by the problems.

According to an aspect of the present invention, there is provided a photosensitive drum assembly that is capable of being combined with a driving shaft including a twisted hole with a non-circular cross-section having a plurality of corners, the photosensitive drum assembly including: a support disposed at one side of the photosensitive drum; and an insertion body disposed at one side of the support and including a plurality of protrusions that are capable of being inserted in the twisted hole, wherein at least portions of each of the plurality of protrusions based on a cross-section of each protrusion that is perpendicular to the driving shaft, closely contacts two side surfaces of the twisted hole that constitute one of the plurality of corners of the twisted hole, respectively.

At least portions of each of the plurality of protrusions may correspond to and may be in surface contact with two side surfaces of the twisted hole that constitute one of the plurality of corners of the twisted hole, respectively.

Each of the plurality of protrusions may closely contact two side surfaces of the twisted hole up to a predetermined distance between the protrusion and the support and may be far away from two side surfaces of the twisted hole from the predetermined distance to a free end of the protrusion.

A length of contact between each protrusion and the twisted hole based on a cross-section of each protrusion that is perpendicular to the driving shaft, may be decreased as the protrusion gets far away from the support.

A length of contact between each protrusion and the twisted hole based on a cross-section of each protrusion that is perpendicular to the driving shaft, may be uniform up to a predetermined distance between the protrusion and the support and may be decreased from the predetermined distance to a free end of the protrusion.

The insertion body may be configured of the plurality of protrusions connected to one another.

The twisted hole may further include curved surfaces formed by combining a non-circular cross-section having a plurality of corners and a circular cross-section, as well as two side surfaces, and the protrusion may closely contact at least portions of the curved surfaces of the twisted hole.

Each protrusion may include a plurality of regularly-arranged concavo-convex portions formed in portions corresponding to two side surfaces that constitute one of the plurality of corners of the twisted hole.

The plurality of regularly-arranged concavo-convex portions of each protrusion may be continuously formed.

The plurality of regularly-arranged concavo-convex portions of each protrusion may be formed in a direction in which the insertion body is inserted in the twisted hole.

Each protrusion may correspond to two side surfaces of the twisted hole up to a predetermined distance between the protrusion and the support and may be spaced apart from the support from the predetermined distance to a free end of the protrusion.

According to another aspect of the present invention, there is provided a process cartridge including a photosensitive drum assembly that is capable of being combined with a driving shaft including a twisted hole with a non-circular cross-section having a plurality of corners, the process cartridge being combined with a main body of an image forming apparatus to be attachable to or detachable from the main body of the image forming apparatus, the process cartridge including: a toner storing container in which toner is stored; and a photosensitive drum assembly to which the toner is supplied from the toner storing container and which prints an image on a recording medium, wherein the photosensitive drum assembly includes: a support disposed at one side of the photosensitive drum; and an insertion body disposed at one side of the support and including a plurality of protrusions that are capable of being inserted in the twisted hole, wherein at least portions of each of the plurality of protrusions based on a cross-section of each protrusion that is perpendicular to the driving shaft, closely contacts two side surfaces of the twisted hole that constitute one of the plurality of corners of the twisted hole, respectively.

At least portions of each of the plurality of protrusions may correspond to and may be in surface contact with two side surfaces of the twisted hole that constitute one of the plurality of corners of the twisted hole, respectively.

Each of the plurality of protrusions may closely contact two side surfaces of the twisted hole up to a predetermined distance between the protrusion and the support and may be far away from two side surfaces of the twisted hole from the predetermined distance to a free end of the protrusion.

A length of contact between each protrusion and the twisted hole based on a cross-section of each protrusion that is perpendicular to the driving shaft, may be decreased as the protrusion gets far away from the support.

A length of contact between each protrusion and the twisted hole based on a cross-section of each protrusion that is perpendicular to the driving shaft, may be uniform up to a predetermined distance between the protrusion and the support and may be decreased from the predetermined distance to a free end of the protrusion.

The insertion body may be configured of the plurality of protrusions connected to one another.

The twisted hole may further include curved surfaces formed by combining a non-circular cross-section having a plurality of corners and a circular cross-section, as well as two side surfaces, and the protrusion may closely contact at least portions of the curved surfaces of the twisted hole.

Each protrusion may include a plurality of regularly-arranged concavo-convex portions formed in portions corresponding to two side surfaces that constitute one of the plurality of corners of the twisted hole.

The plurality of regularly-arranged concavo-convex portions of each protrusion may be continuously formed.

The plurality of regularly-arranged concavo-convex portions of each protrusion may be formed in a direction in which the insertion body is inserted in the twisted hole.

Each protrusion may correspond to two side surfaces of the twisted hole up to a predetermined distance between the protrusion and the support and may be spaced apart from the support from the predetermined distance to a free end of the protrusion.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
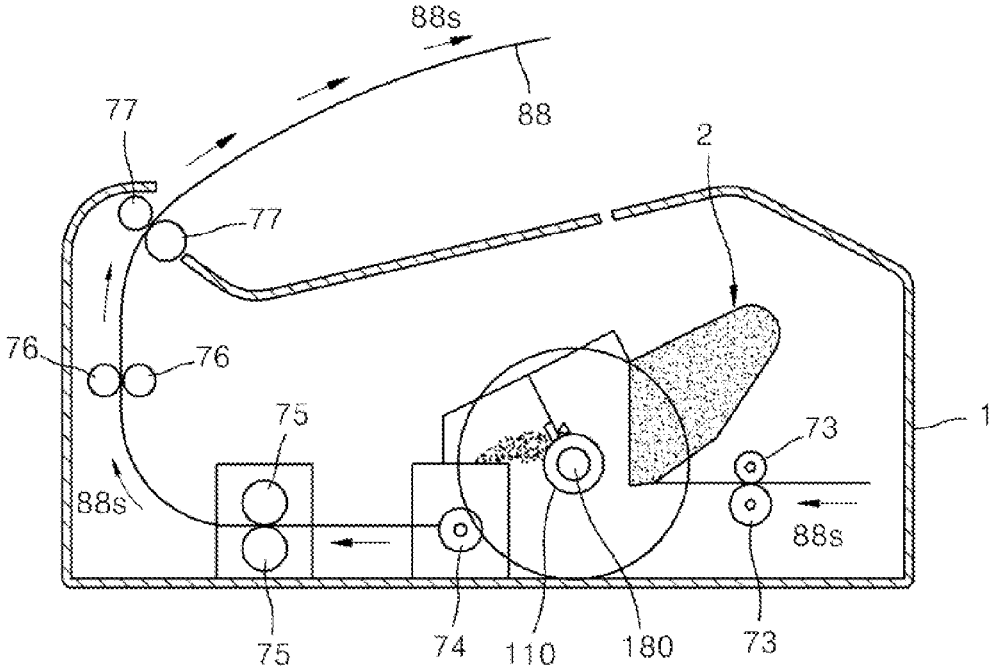
FIG. 1 PRIOR ART
FIG. 1 is a schematic view of a structure of an image forming apparatus according to the related art.
Figure 2:
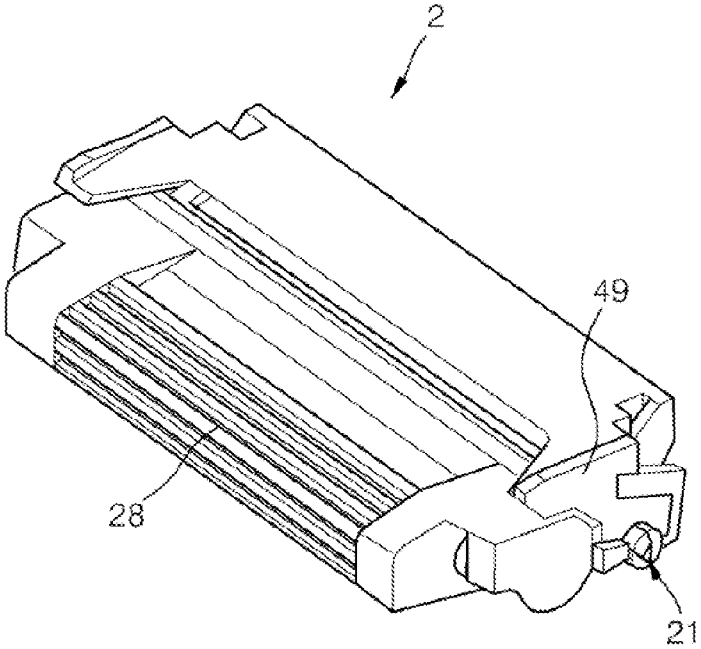
FIG. 2 PRIOR ART
FIG. 2 is a perspective view of an appearance of a process cartridge of the image forming apparatus illustrated in FIG. 1.
Figure 3:
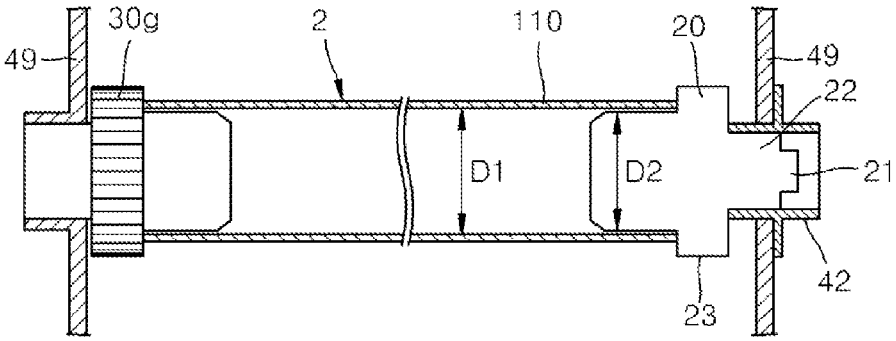
FIG. 3 PRIOR ART
FIG. 3 is a cross-sectional view of a photosensitive drum of the process cartridge of FIG. 1 and peripheral elements of the process cartridge.
Figure 4:
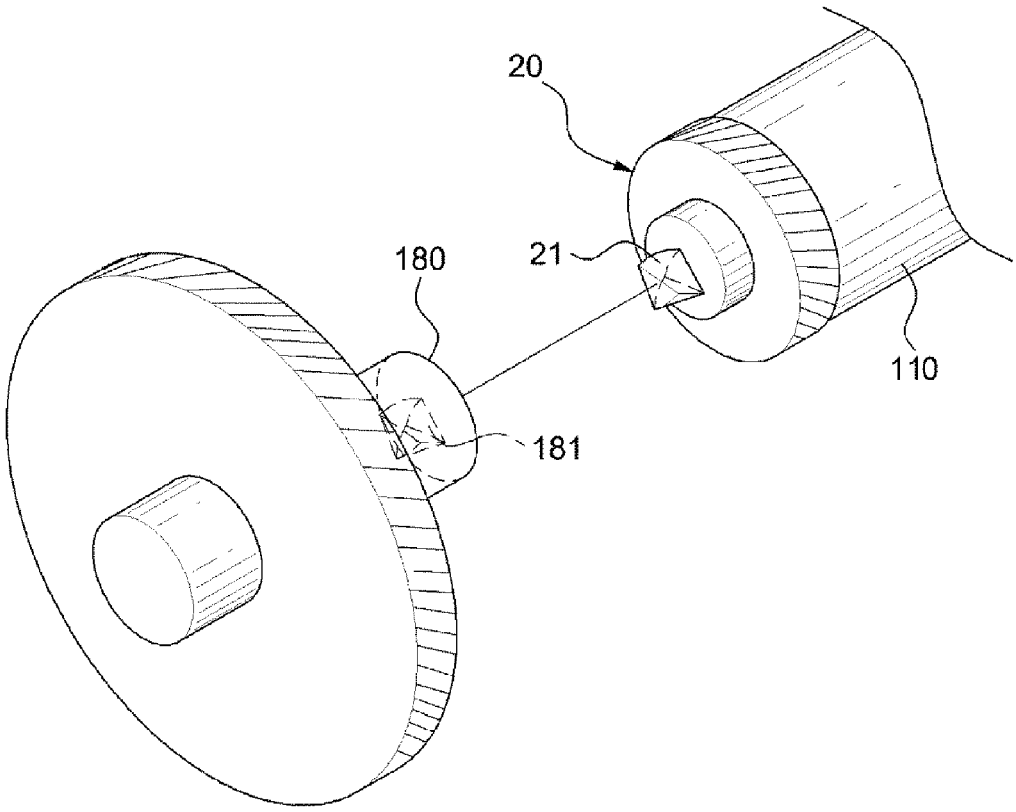
FIG. 4 PRIOR ART
FIGS. 4 and 5 are perspective views of a rotation driving force transmitting structure of an image forming apparatus according to the related art.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In addition, for convenience of explanation, the sizes of elements in the drawings may be exaggerated or reduced.

A "cross-section" or a "cross-section that is perpendicular to a driving shaft" used herein indicates a cross-section that is perpendicular to or is approximately perpendicular to an axis of the driving shaft.

Figure 6:
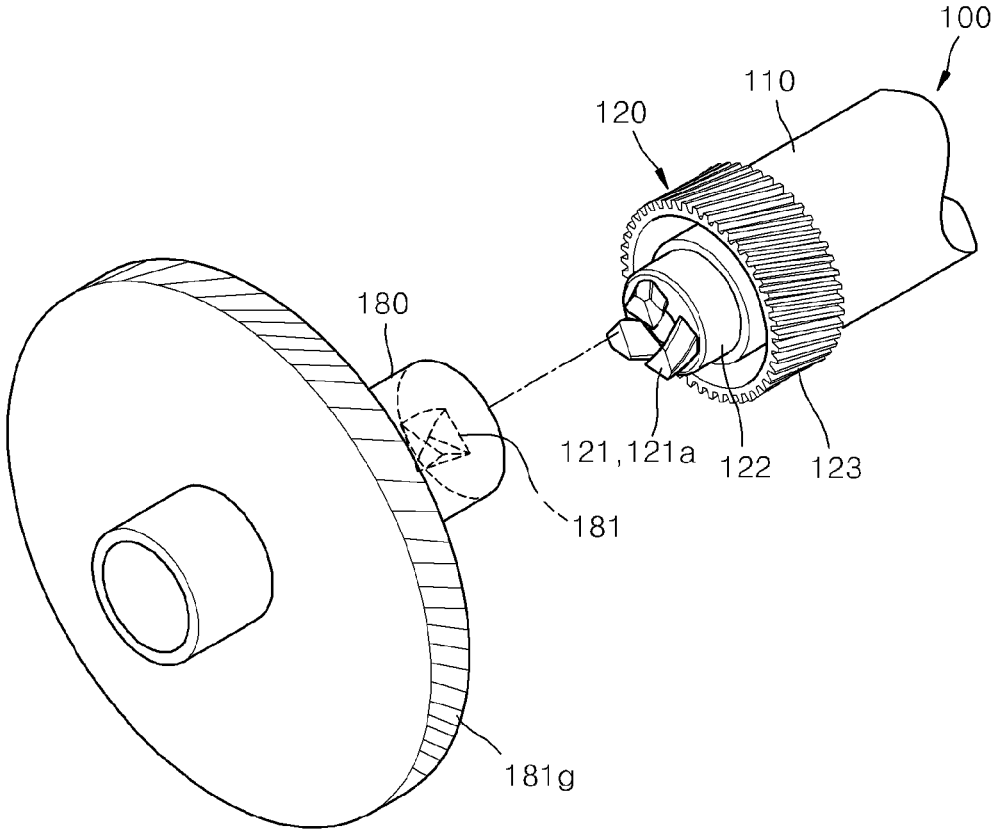
FIG. 6 is a schematic perspective view of a driving force transmitting structure of a driving photosensitive drum assembly and a process cartridge according to an embodiment of the present invention.

FIG. 6 is a schematic perspective view of a rotation driving force transmitting structure of an image forming apparatus according to an embodiment of the present invention. Referring to FIG. 6, when a process cartridge 2 is inserted in a main body 1 of the image forming apparatus, an insertion body 121 of a driving assembly 120 for a photosensitive drum 110 that is combined with one side of the photosensitive drum 110 disposed on the process cartridge 2, is inserted in a twisted hole 181 of a driving shaft 180 disposed on the main body 1. As the driving shaft 180 is rotated by a driving motor installed in the main body 1 of the image forming apparatus, the twisted hole 181 of the driving shaft 180 and the insertion body 121 are combined with each other and are rotated, a driving force provided by the driving motor may be transmitted to the photosensitive drum 110, and the photosensitive drum 110 may also be rotated.

Figure 7:
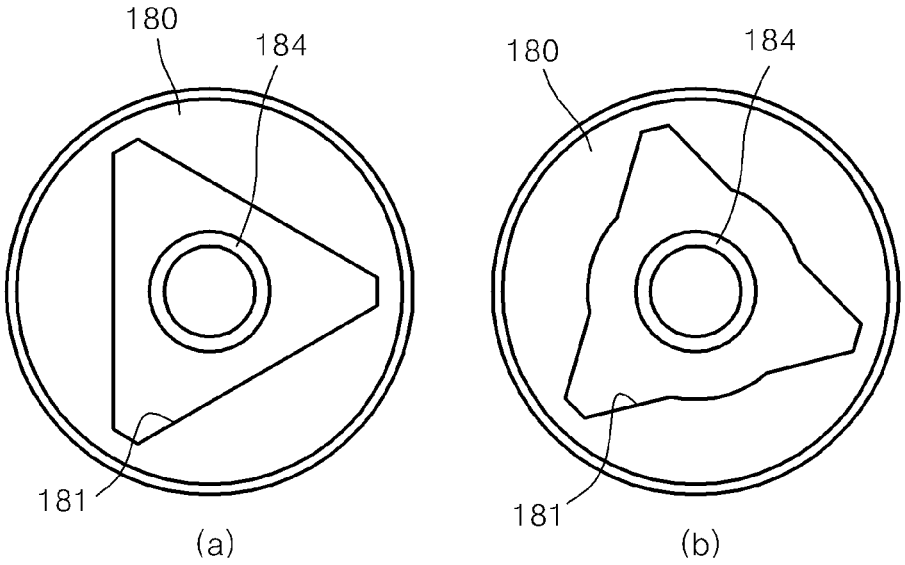
FIGS. 7A and 7B are plan views of a driving shaft and a twisted hole of the driving force transmitting structure illustrated in FIG. 6.

FIGS. 7A and 7B are plan views of the driving shaft 180 and the twisted hole 181 of the driving force transmitting structure illustrated in FIG. 6. Referring to FIGS. 7A and 7B, the twisted hole 181 may have a non-circular cross-section having a plurality of corners. For example, the twisted hole 181 may have an approximately triangular cross-section, as illustrated in FIG. 7A. In this case, distances between a central axis of the driving shaft 180 and the plurality of corners of the twisted hole 181 may be approximately the same.

Furthermore, as illustrated in FIG. 7B, an approximately triangular cross-section and a circular cross-section of the twisted hole 181 may be combined with each other. That is, the twisted hole 181 may have an approximately triangular cross-section and may have arcs, of which a central part of each of side surfaces of the twisted hole 181 is embossed. Thus, the twisted hole 181 may further include curved surfaces, as well as the side surfaces. Here, each of the arcs may have the same central axis. That is, the twisted hole 181 may be embossed in an approximately triangular shape and may have a shape in which the twisted hole 181 is further embossed as a circle having the same central axis as a triangular central axis. In addition, a center of each arc and a center of a triangle may be the same. Here, portions of twisted side surfaces of the twisted hole 181 may be dug into the curved surfaces of the twisted hole 181. The curved surfaces of the twisted hole 181 may be parallel to the axis of the driving shaft 180.

Obviously, the twisted hole 181 is not limited to the above-described example but may have other polygonal cross-sections, such as a rectangular cross-section, and the like.

In addition, the twisted hole 181 may include a guide bar 184 disposed in the middle of the twisted hole 181. For example, the guide bar 184 may be cylindrical. As the guide bar 184 gets far away from the driving shaft 180, the size of a cross-section of the guide bar 184 may be decreased, or a corner of an end of the guide bar 184 may be cut. That is, at least portions of the guide bar 184 may be tapered or trimmed. In this case, the center of the guide bar 184, the center of each arc, and the center of the triangle may be the same. Here, the central axis of the driving shaft 180 may be the same as the centers of the guide bar 184, each arc, and the triangle.

The driving shaft 180 may include a gear portion 181*g* to which a driving force is transmitted from the driving motor.

A photosensitive drum assembly 100 according to other embodiments of the present invention includes a photosensitive drum 110 and a driving assembly 120 for the photosensitive drum 110 that is installed at the photosensitive drum 110. The photosensitive drum assembly 100 is combined with the driving shaft 180 that is rotated at the main body 1 of the image forming apparatus, and a rotation force is transmitted to the photosensitive drum assembly 100.

The driving assembly 120 for the photosensitive drum 110 may include a support 122 that is inserted in one side of the photosensitive drum 110 and is fixed thereto, and the insertion body 121 that protrudes from the support 122 and is inserted in the twisted hole 181. The driving assembly 120 for the photosensitive drum 110 may further include a gear portion 123 that is rotated by the rotation driving force transmitted from the driving shaft 180 and transmits a rotation force to a developing unit in the process cartridge 2. Hereinafter, the driving assembly 120 for the photosensitive drum 110 will be described in detail with reference to the accompanying drawings.

The insertion body 121 according to an embodiment of the present invention will be described with reference to FIGS. 8A through 8D and FIG. 9.

Figure 8:
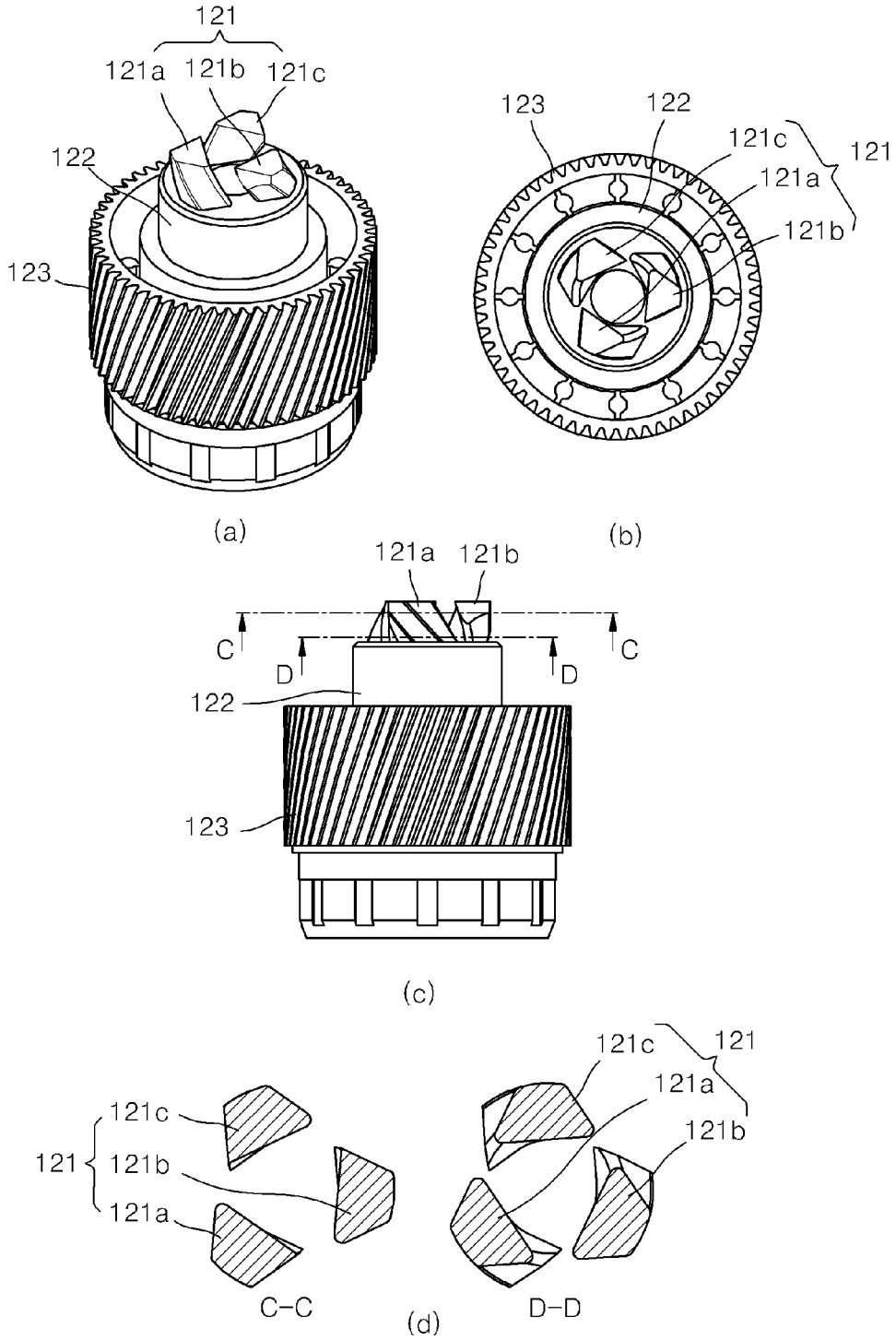
FIGS. 8A through 8D are a perspective view, a plan view, a side view, and a cross-sectional view of a driving assembly for a photosensitive drum, according to an embodiment of the present invention.
Figure 9:
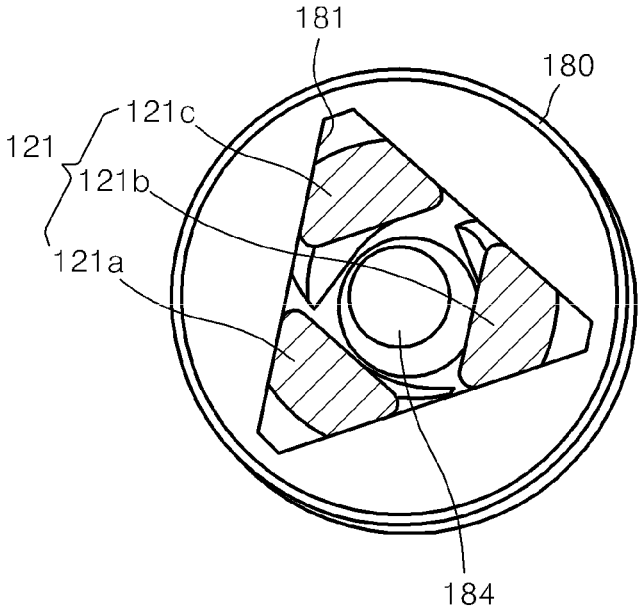
FIG. 9 is a view showing the case that an insertion body of the driving assembly for a photosensitive drum illustrated in FIGS. 8A through 8D and a twisted hole are combined with each other.
Figure 10:
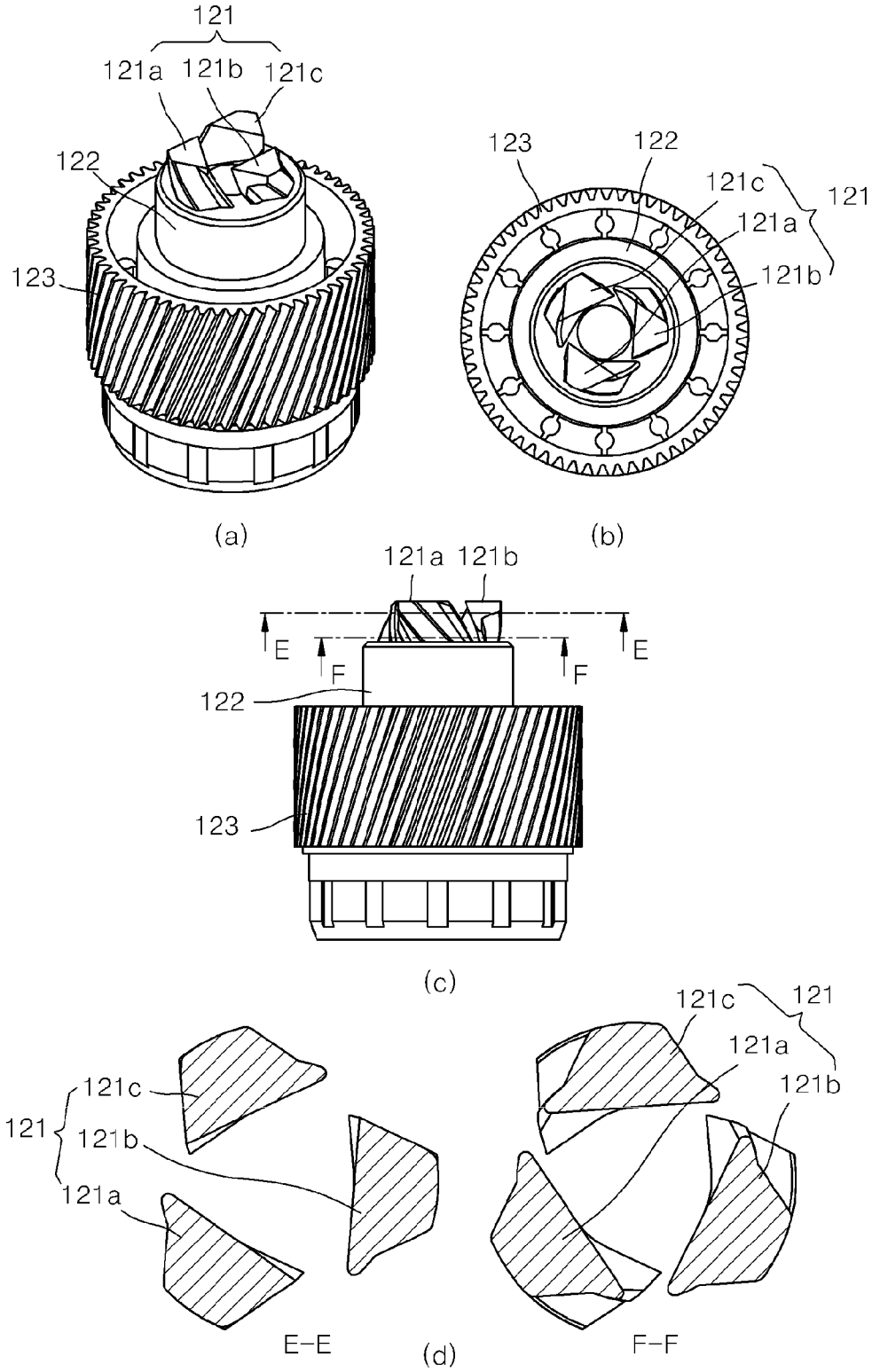
FIGS. 10A through 10D are a perspective view, a plan view, a side view, and a cross-sectional view of a driving assembly for a photosensitive drum, according to another embodiment of the present invention.
Figure 11:
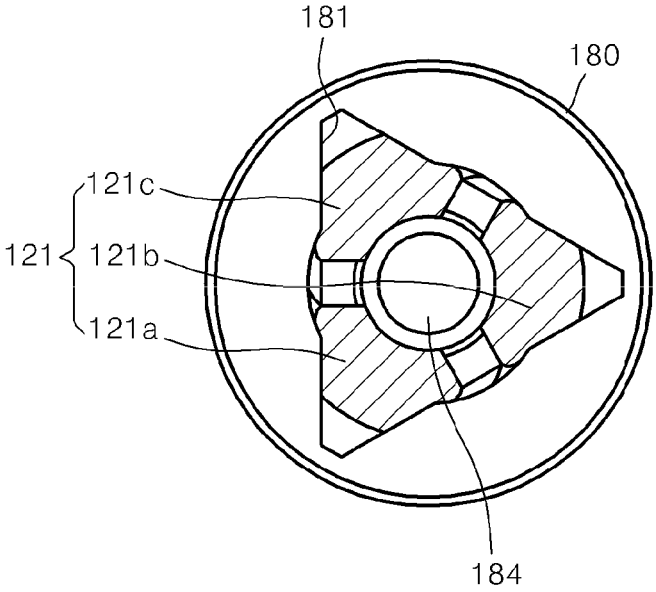
FIG. 11 is a view showing the case that an insertion body of the driving assembly for a photosensitive drum illustrated in FIGS. 10A through 10D and a twisted hole are combined with each other.

FIGS. 8A through 8D are a perspective view, a plan view, a side view, and a cross-sectional view of the driving assembly 120 for the photosensitive drum 110, according to an embodiment of the present invention, and FIG. 9 is a view showing the case that the insertion body 121 of the driving assembly 120 for the photosensitive drum 110 illustrated in FIGS. 8A through 8D and the twisted hole 181 are combined with each other.

According to embodiments of the present invention, the insertion body 121 may include a plurality of protrusions 121*a*, 121*b*, and 121*c*. The insertion body 121 may be inserted in the twisted hole 181. In more detail, the insertion body 121 may have the plurality of protrusions 121*a*, 121*b*, and 121*c* that are inserted in the corners of the twisted hole 181, respectively. Here, the number of the protrusions 121*a*, 121*b*, and 121*c* of the insertion body 121 may correspond to the number of corners of the twisted hole 181 of the driving shaft 180.

For example, referring to FIGS. 8A through 8D, when the number of corners of the twisted hole 181 is three, the number of protrusions 121*a*, 121*b*, and 121*c* of the insertion body 121 may be three. Hereinafter, since the plurality of protrusions 121*a*, 121*b*, and 121*c* may be the same, one protrusion 121*a* thereof will now be described.

In order to transmit the rotation force of the driving motor to the photosensitive drum 110, at least portions of one of a plurality of protrusions 121*a* may closely contact two side surfaces that constitute one of a plurality of corners of the twisted hole 181, respectively. For example, the protrusions 121*a* of the insertion body 121 may be in point, line, or surface contact with the side surfaces of the twisted hole 181.

Hereinafter, the case that the side surfaces of the twisted hole 181 and the protrusions 121*a* of the insertion body 121 contact one another, will be described in greater detail. Here, since the protrusions 121*a* of the insertion body 121 have the same shapes, one protrusion 121*a* will now be described.

At least portions of the protrusion 121*a* of the insertion body 121 may be in surface contact with two side surfaces that constitute one of a plurality of corners of the twisted hole 181, respectively. That is, the protrusion 121*a* of the insertion body 121 may have a shape corresponding to a shape of the twisted hole 181. In other words, the protrusion 121*a* of the insertion body 121 may have a complementary shape to the shape of the twisted hole 181. Thus, when the protrusion 121*a* of the insertion body 121 is inserted in the twisted hole 181, the protrusion 121*a* of the insertion body 121 may contact the twisted hole 181 so that there is no empty space in at least portions of the protrusion 121*a* of the insertion body 121.

In view of the contact relationship between the protrusion 121*a* of the insertion body 121 and the twisted hole 181, the protrusion 121*a* of the insertion body 121 has two side surfaces that correspond to two side surfaces of the twisted hole 181 that constitute one of the plurality of corners of the twisted hole 181, so that at least portions of the protrusion 121*a* of the insertion body 121 may be in surface contact with two side surfaces of the twisted hole 181 that constitute one of the plurality of corners of the twisted hole 181, respectively.

Since the protrusion 121*a* of the insertion body 121 and the twisted hole 181 have side surfaces that are in correspondence, the protrusion 121*a* of the insertion body 121 may be in line contact with the twisted hole 181 based on a cross-section of the protrusion 121*a*, and the protrusion 121*a* as a whole may be in surface contact with the twisted hole 181. That is, the side surfaces of the protrusion 121*a* of the insertion body 121 and the side surfaces of the twisted hole 181 that are in correspondence may be in surface contact with one another. The side surfaces of the protrusion 121*a* of the insertion body 121 may be in surface contact with the side surfaces of the twisted hole 181 that are located in a rotation direction of the driving shaft 180 and in an opposite direction to the rotation direction of the driving shaft 180.

In other words, two side surfaces of the protrusion 121*a* of the insertion body 121 may be in line contact with two side surfaces that constitute one of a plurality of corners of the twisted hole 181 based on a cross-section of the protrusion 121*a*, and two side surfaces of the protrusion 121*a* as a whole may be in surface contact with two side surfaces of the twisted hole 181.

In addition, since the protrusion 121*a* of the insertion body 121 has the shape corresponding to the twisted hole 181, the twisted shape of the protrusion 121*a* of the insertion body 121 and the twisted side surfaces of the twisted hole 181 are coincident with each other, and a twisted direction of the protrusion 121*a* of the insertion body 121 and a twisted direction of the twisted hole 181 may be coincident with each other.

Here, two side surfaces of the protrusion 121*a* of the insertion body 121 may be consecutively connected to each other, as illustrated in FIGS. 8A through 8D. Thus, the protrusion 121*a* of the insertion body 121 may be more easily inserted in the twisted hole 181 without being caught in the twisted hole 181.

Three protrusions 121*a* of the insertion body 121 may be spaced apart from each other by a predetermined distance so that the guide bar 184 of the twisted hole 181 may be inserted between three protrusions 121*a*. In this case, when the guide bar 184 of the twisted hole 181 is cylindrical, each of three protrusions 121*a* of the insertion body 121 may include a shape corresponding to the cylindrical shape of the guide bar 184. Here, each of the protrusions 121*a* of the insertion body 121 may encompass portions of the guide bar 184 of the twisted hole 181. Since the guide bar 184 of the twisted hole 181 is inserted in a central hollow of the protrusion 121*a* of the insertion body 121, when the protrusion 121*a* of the insertion body 121 and the twisted hole 181 are combined with each other, precise combination may be induced.

As illustrated in FIGS. 8A through 8D and FIG. 9, when the twisted hole 181 has a triangular cross-section, the corners of the twisted hole 181 may be spaced apart from each other by a predetermined distance so as to form an angle of about 120° based on the central axis of the driving shaft 180. In addition, the protrusion 121*a* of the insertion body 121 is inserted close to one of the plurality of corners of the twisted hole 181, the protrusions 121*a* of the insertion body 121 may be spaced apart from each other by a predetermined distance so as to form an angle of about 120° based on a rotation axis of the support 122.

The protrusions 121*a* of the insertion body 121 may be fabricated by making a mold in a shape that is the same as or similar to the shape of the twisted hole 181. The mold may be the same as the twisted hole 181 in at least portions of a surface on which the twisted hole 181 and the protrusions 121*a* of the insertion body 121 contact each other. In this case, the insertion body 121 may be slightly larger than the twisted hole 181.

In the above-described embodiment, although the twisted hole 181 is formed as the triangular cross-section among non-circular cross-sections, as illustrated in FIG. 8, the twisted hole 181 may have the triangular cross-section and the circular cross-section, as illustrated in FIG. 7B. In more detail, the twisted hole 181 may have the triangular cross-section and the circular cross-section, as illustrated in FIG. 7B, and the protrusions 121*a* of the insertion body 121 may not correspond to the curved surfaces of the twisted hole 181 but may correspond only to twisted side surfaces of the twisted hole 181.

Figure 5:
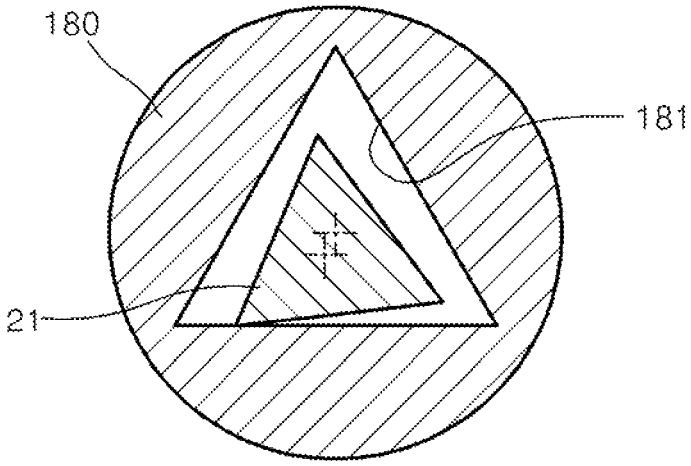
FIG. 5 PRIOR ART

Comparing FIG. 5 with FIG. 9, since a driving force is transmitted to the twisted protrusion 21 of FIG. 5 according to the related art based on the cross-section of the twisted protrusion 21 due to point contact, stress is concentrated on a small contact point, and thus the contact portion is easily damaged, as described above. In addition, when the contact portion of the twisted protrusion 21 illustrated in FIG. 5 and the twisted hole 181 is damaged due to repetitive contact, the driving force is not easily transmitted to the twisted protrusion 21 of FIG. 5.

However, according to the current embodiment of the present invention, the insertion body 121 corresponds to one of a plurality of corners of the twisted hole 181 and thus may be stably inserted in the twisted hole 181. In addition, since the insertion body 121 contacts two side surfaces that constitute one of a plurality of corners of the twisted hole 181, the size of the insertion body 121 may be maximized, and the insertion body 121 is securely supported by the support 122, and thus the driving force may be stably transmitted to the insertion body 121. In addition, the insertion body 121 may maximize a contact area between the insertion body 121 and the twisted hole 181 and thus the driving force may be divergently received. As such, fatigue destruction of the insertion body 121 may be prevented, and fatigue destruction of the twisted hole 181 may also be prevented.

FIGS. 10A through 10D and FIG. 11 illustrate protrusions 121*a* of an insertion body 121 according to another embodiment of the present invention. FIGS. 10A through 10D and FIG. 11 are different from FIGS. 8A through 8D and FIG. 9 in that the shape of a twisted hole 181 of FIGS. 10A through 10D and FIG. 11 is different from that of FIGS. 8A through 8D and FIG. 9 and thus the shape of each protrusion 121*a* of the insertion body 121 of FIGS. 10A through 10D and FIG. 11 is different from that of FIGS. 8A through 8D and FIG. 9, and redundant descriptions thereof will be omitted.

The twisted hole 181 may further include curved surfaces that are formed by combining a triangular cross-section and a circular cross-section of the twisted hole 181, as well as the side surfaces. In this case, the protrusions 121*a* of the insertion body 121 may contact the side surfaces of the twisted hole 181, as in the above-described embodiment. However, the protrusions 121*a* of the insertion body 121 may also contact the curved surfaces of the twisted hole 181 so as to increase an area of the insertion body 121 to which the driving force is transmitted from the driving motor, when the twisted hole 181 is rotated.

Each of the protrusions 121*a* of the insertion body 121 may include a portion that contacts the twisted side surfaces of the twisted hole 181 and a portion that contacts the curved surfaces of the twisted hole 181. Here, the protrusions 121*a* of the insertion body 121 may contact two curved surfaces that are located at both sides of one of the plurality of corners of the twisted hole 181, or only one of two curved surfaces. Alternatively, the protrusions 121*a* of the insertion body 121 may contact two curved surfaces of the twisted hole 181 in a portion where the protrusions 121*a* are adjacent to the support 122, and as the protrusions 121*a* get far away from the support 122, the protrusions 121*a* of the insertion body 121 may contact only one of two curved surfaces of the twisted hole 181.

FIGS. 13A through 13D and FIG. 14 illustrate protrusions 121*a* of an insertion body 121 according to another embodiment of the present invention. FIGS. 13A through 13D and FIG. 14 are different from FIGS. 8A through 8D and FIG. 9 in that the protrusions 121*a* of the insertion body 121 of FIGS. 13A through 13D and FIG. 14 further include a plurality of regularly-arranged concavo-convex portions 124. Thus, since the contact relationship between the protrusions 121*a* of the insertion body 121 and the twisted hole 181 has been changed, the contact relationship will now be described, and redundant descriptions thereof will be omitted.

Each of the protrusions 121*a* of the insertion body 121 may include the plurality of regularly-arranged concavo-convex portions 124 that are formed in portions corresponding to two side surfaces that constitute one of the plurality of corners of the twisted hole 181. For example, the plurality of regularly-arranged concavo-convex portions 124 may be formed in portions where each of the protrusions 121*a* of the insertion body 121 contact the twisted hole 181, as described above. Each protrusion 121*a* of the insertion body 121 may include two side surfaces corresponding to two side surfaces of the twisted hole 181 that constitute one of the plurality of corners of the twisted hole 181, and one or more regularly-arranged concavo-convex portions 124 formed on two side surfaces of each protrusion 121*a* of the insertion body 121.

Each protrusion 121*a* of the insertion body 121 may be in multiple-point contact with the side surfaces of the twisted hole 181 based on the cross-section of the protrusion 121*a* due to the plurality of regularly-arranged concavo-convex portions 124. That is, the protrusion 121*a* of the insertion body 121 may be in line or point contact with two side surfaces of the twisted hole 181 due to the regularly-arranged concavo-convex portions 124. Here, a plurality of regularly-arranged concavo-convex portions 124 may be formed, and the following description will be provided from the premise.

In more detail, the plurality of regularly-arranged concavo-convex portions 124 are formed on side surfaces of the protrusion 121*a* where the protrusion 121*a* of the insertion body 121 and the twisted hole 181 are in surface contact with each other, as in the above-described embodiment. In this case, the regularly-arranged concavo-convex portions 124 may protrude from one direction of the protrusion 121*a* of the insertion body 121 continuously or discontinuously. For example, the regularly-arranged concavo-convex portions 124 may have a shape of wrinkles that extend in one direction of the protrusion 121*a*, as illustrated in FIGS. 13A through 13D, or a plurality of wedge shapes, unlike in FIGS. 13A through 13D. Here, in the regularly-arranged concavo-convex portions 124, same patterns may be continuously repeatedly formed. In addition, the regularly-arranged concavo-convex portions 124 may be formed on the side surfaces of the protrusion 121*a* of the insertion body 121 at the same heights.

Thus, the protrusion 121*a* of the insertion body 121 having the regularly-arranged concavo-convex portions 124 that protrude from one direction of the protrusion 121*a* of the insertion body 121 continuously, may be in point contact with the twisted hole 181 based on the cross-section of the protrusion 121*a*. The protrusion 121*a* as a whole may be in line contact with the twisted hole 181. Alternatively, the protrusion 121*a* of the insertion body 121 with the regularly-arranged concavo-convex portions 124 having a plurality of wedge shapes may be in point contact with the twisted hole 181 based on the cross-section of the protrusion 121*a*. The protrusion 121*a* as a whole may be in point contact with the twisted hole 181.

The regularly-arranged concavo-convex portions 124 may have various shapes of patterns, as illustrated in FIGS. 22A through 22E.

When the regularly-arranged concavo-convex portions 124 protrude from one direction of the protrusion 121*a* of the insertion body 121 continuously, the regularly-arranged concavo-convex portions 124 may extend in a direction in which the insertion body 121 is inserted in the twisted hole 181. That is, the extending direction of the concavo-convex portions 124 may be the same as a twisted direction of the side surfaces of the protrusion 121*a* of the insertion body 121. In other words, the regularly-arranged concavo-convex portions 124 may be continuously formed in the same direction as the twisted direction of the side surfaces of the protrusion 121*a* of the insertion body 121.

Thus, the regularly-arranged concavo-convex portions 124 may be approximately coincident with a twisted angle of the twisted hole 181 and may be coincident with the twisted direction of the twisted hole 181. The regularly-arranged concavo-convex portions 124 may reduce friction that occurs when the protrusion 121*a* of the insertion body 121 is inserted in the twisted hole 181.

In addition, the regularly-arranged concavo-convex portions 124 may reduce friction that occurs when the protrusion 121*a* of the insertion body 121 is separated from the twisted hole 181. Thus, the protrusion 121*a* of the insertion body 121 may be more easily inserted in or separated from the twisted hole 181.

In addition, since a powder type of toner is stored in the process cartridge 2, the toner may scatter in the image forming apparatus and may be accumulated on each of elements of the image forming apparatus. In this case, if the toner is accumulated on the twisted hole 181 or the protrusion 121*a* of the insertion body 121, the protrusion 121*a* of the insertion body 121 is not easily inserted in the twisted hole 181 due to the toner. Even when the protrusion 121*a* of the insertion body 121 is inserted in the twisted hole 181, the protrusion 121*a* of the insertion body 121 is securely engaged with the twisted hole 181 and thus may not be separated from the twisted hole 181.

However, if the protrusion 121*a* of the insertion body 121 includes the regularly-arranged concavo-convex portions 124, when the protrusion 121*a* of the insertion body 121 is inserted in the twisted hole 181, the toner may be pushed between the regularly-arranged concavo-convex portions 124 and thus combination and separation of the protrusion 121*a* of the insertion body 121 and the twisted hole 181 may not be affected by the toner. This, the protrusion 121*a* of the insertion body 121 may be more easily attached to or detached from the twisted hole 181.

Figure 14:
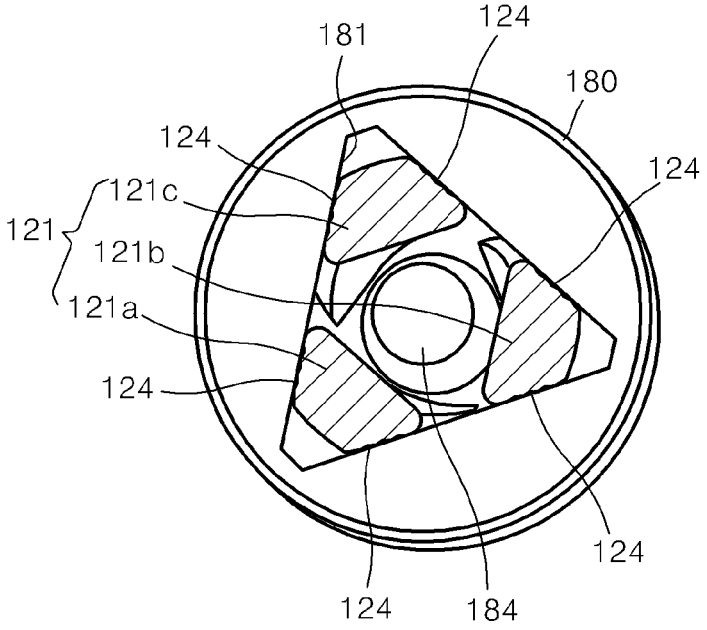
FIG. 14 is a view showing the case that an insertion body of the driving assembly for a photosensitive drum illustrated in FIGS. 13A through 13D and a twisted hole are combined with each other.
Figure 15:
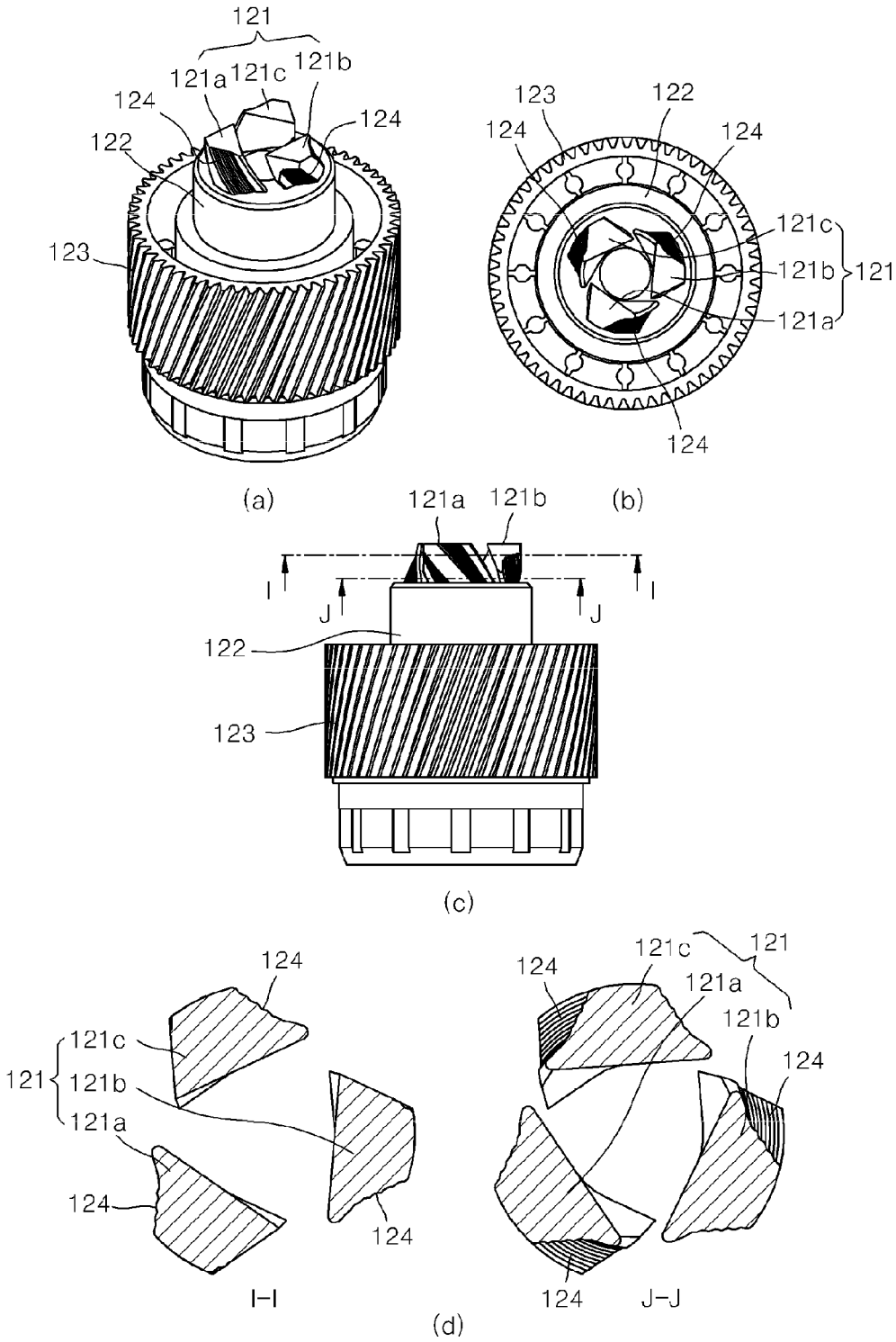
FIGS. 15A through 15D are a perspective view, a plan view, a side view, and a cross-sectional view of a driving assembly for a photosensitive drum, according to another embodiment of the present invention.
Figure 16:
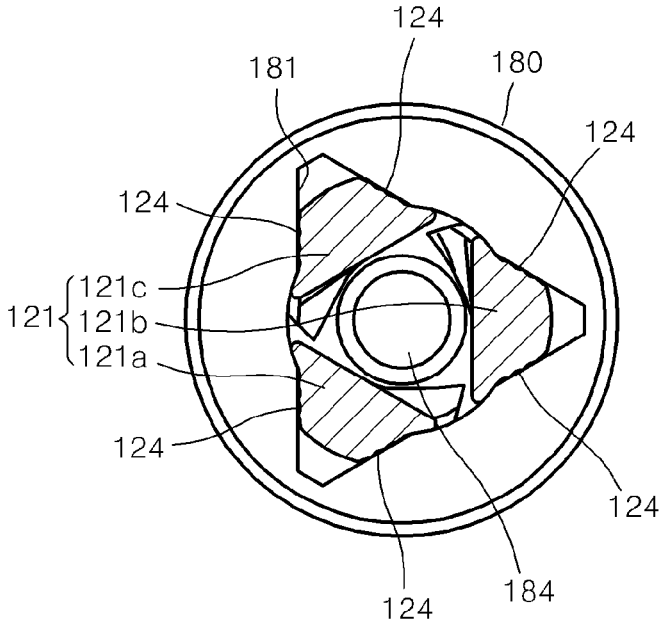
FIG. 16 is a view showing the case that an insertion body of the driving assembly for a photosensitive drum illustrated in FIGS. 15A through 15D and a twisted hole are combined with each other.

In the above-described embodiment, the twisted hole 181 is formed as the triangular cross-section among non-circular cross-sections, as illustrated in FIG. 14. However, the twisted hole 181 may have the triangular cross-section and the circular cross-section, as illustrated in FIG. 7B. In more detail, the twisted hole 181 may have the triangular cross-section and the circular cross-section, as illustrated in FIG. 7B, and the protrusions 121*a* of the insertion body 121 may not correspond to the curved surfaces of the twisted hole 181 but may correspond only to twisted side surfaces of the twisted hole 181.

FIGS. 15A through 15D and FIG. 16 illustrate protrusions 121*a* of an insertion body 121 according to another embodiment of the present invention. FIGS. 15A through 15D and FIG. 16 are different from FIGS. 13A through 13D and FIG. 14 in that the shape of a twisted hole 181 of FIGS. 15A through 15D and FIG. 16 is different from that of FIGS. 13A through 13D and FIG. 14 and thus the shape of the protrusions 121*a* of the insertion body 121 is different from that of FIGS. 13A through 13D and FIG. 14, and redundant descriptions thereof will be omitted.

The twisted hole 181 may further include curved surfaces that are formed by combining a triangular cross-section and a circular cross-section of the twisted hole 181, as well as the side surfaces. In this case, the protrusions 121*a* of the insertion body 121 may contact only the side surfaces of the twisted hole 181, as in the above-described embodiment. However, the protrusions 121*a* of the insertion body 121 may also contact the curved surfaces of the twisted hole 181 so as to increase an area of the insertion body 121 to which the driving force is transmitted from the driving motor, when the twisted hole 181 is rotated.

Each of the protrusions 121*a* of the insertion body 121 may include a portion that corresponds to the twisted side surfaces of the twisted hole 181 and a portion that corresponds to the curved surfaces of the twisted hole 181. Here, the protrusions 121*a* of the insertion body 121 may correspond to two curved surfaces that are located at both sides of one corner of the twisted hole 181, or only one of two curved surfaces. Alternatively, the protrusions 121*a* of the insertion body 121 may correspond to two curved surfaces of the twisted hole 181 in a portion where the protrusions 121*a* are adjacent to the support 122, and as the protrusions 121*a* get far away from the support 122, the protrusions 121*a* of the insertion body 121 may correspond to only one of two curved surfaces of the twisted hole 181.

In addition, a plurality of regularly-arranged concavo-convex portions 124 may be formed on the side surfaces of the protrusion 121*a* of the insertion body 121 that correspond to the curved surfaces of the twisted hole 181. Thus, the protrusion 121*a* of the insertion body 121 includes the plurality of regularly-arranged concavo-convex portions 124 and may be in point or line contact with the twisted hole 181. Here, since the regularly-arranged concavo-convex portions 124 may be formed as in the above-described embodiment, detailed descriptions thereof will be omitted.

Figure 12:
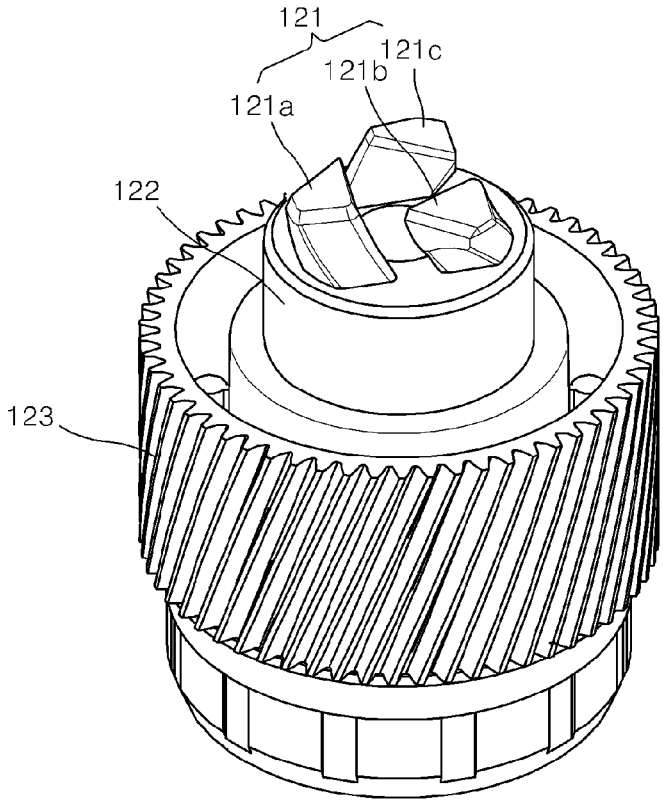
FIG. 12 is a perspective view of a driving assembly for a photosensitive drum, according to another embodiment of the present invention.
Figure 13:
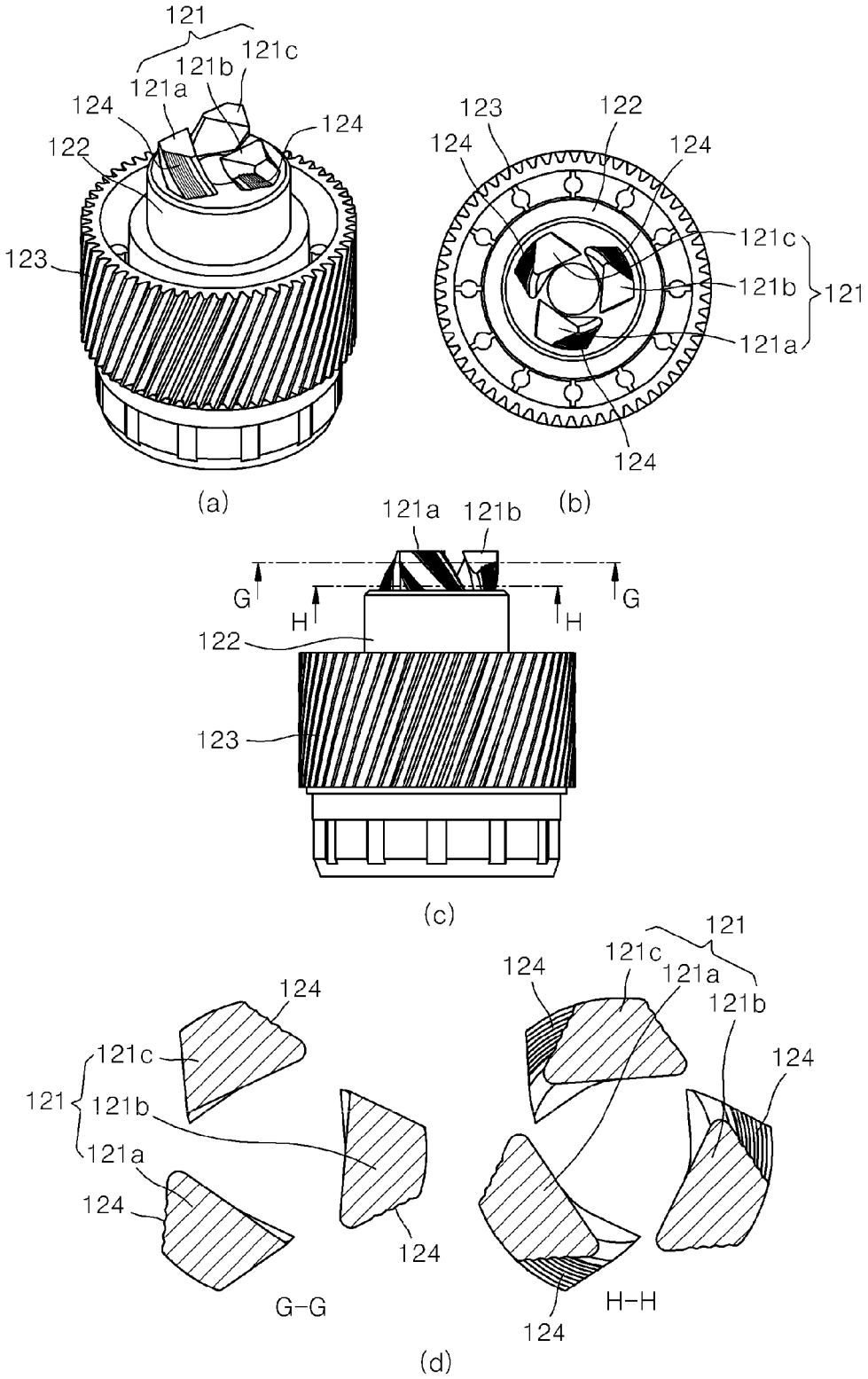
FIGS. 13A through 13D are a perspective view, a plan view, a side view, and a cross-sectional view of a driving assembly for a photosensitive drum, according to another embodiment of the present invention.
Figure 17:
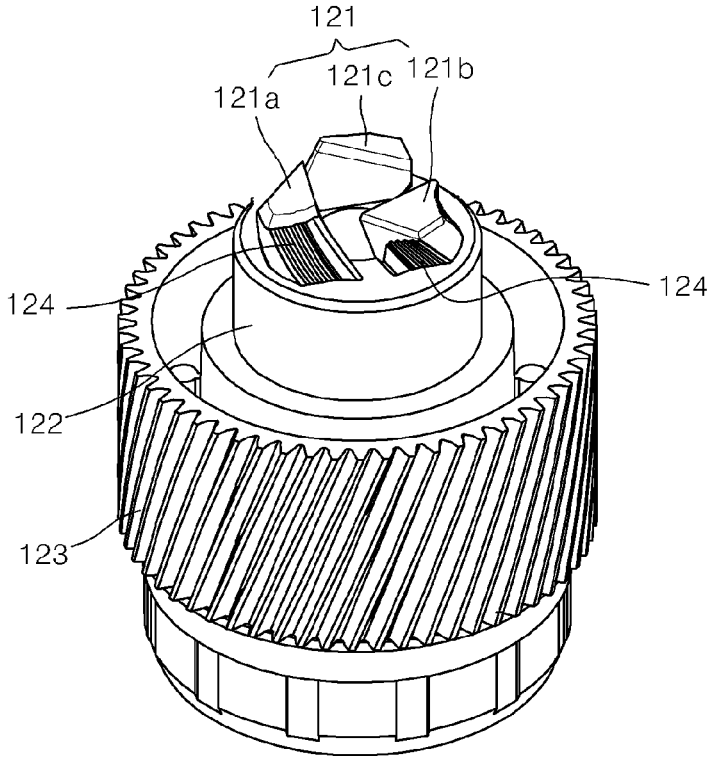
FIG. 17 is a perspective view of a driving assembly for a photosensitive drum, according to another embodiment of the present invention.

FIGS. 12 and 17 illustrate protrusions 121*a* of an insertion body 121 according to another embodiment of the present invention. FIGS. 12 and 17 are different from the above-described embodiments only in that the shape of the protrusions 121*a* of the insertion body 121 of FIGS. 12 and 17 is different from the shape of the protrusions 121*a* of the insertion body 121 in the above-described embodiments, and thus redundant descriptions thereof will be omitted.

Referring to FIG. 12, each of the protrusions 121*a* of the insertion body 121 may correspond to two side surfaces of the twisted hole 181 up to a predetermined distance between the protrusion 121*a* and the support 122 and may be far away from two side surfaces of the twisted hole 181 from the predetermined distance to a free end of the protrusion 121*a* of the insertion body 121. Here, the free end of the protrusion 121*a* of the insertion body 121 refers to an end of the protrusion 121*a* that is far away from the support 122.

For example, the protrusion 121*a* of the insertion body 121 includes multiple steps and may contact the twisted hole 181 up to a predetermined distance between the protrusion 121*a* and the support 122 and may not contact the twisted hole 181 from the predetermined distance to the free end of the protrusion 121*a* of the insertion body 121.

Furthermore, the protrusion 121*a* of the insertion body 121 may be inclined to be far away from the twisted hole 181 as it gets far away from the support 122. An end of the protrusion 121*a* of the insertion body 121 that is far away from the support 122 may be tapered. Alternatively, an end of the protrusion 121*a* of the insertion body 121 that is far away from the support 122 may be trimmed. That is, a corner of an end of the protrusion 121*a* of the insertion body 121 that is far away from the support 122 may be rounded or cut.

In this case, only a part of a corner of an end of the protrusion 121*a* of the insertion body 121 that is far away from the support 122 may be trimmed. For example, the whole of the corner of the end of the protrusion 121*a* of the insertion body 121 may be trimmed, as illustrated in FIG. 12; however, a corner of a surface on which the protrusion 121*a* of the insertion body 121 contacts the twisted hole 181, may be trimmed.

In this case, the protrusion 121*a* of the insertion body 121 is in line contact with the twisted hole 181 based on a cross-section of the protrusion 121*a* up to a predetermined distance between the protrusion 121*a* and the support 122. The protrusion 121*a* as a whole may be in surface contact with the twisted hole 181. The protrusion 121*a* of the insertion body 121 may not contact the twisted hole 181 from the predetermined distance to an opposite end to the support 122.

Unlike in FIG. 12, the protrusion 121*a* of the insertion body 121 may be inclined from the support 122 to the free end, or may be inclined in a double manner so that a middle portion of the protrusion 121*a* of the insertion body 121 protrudes from the twisted hole 181. In this case, the protrusion 121*a* of the insertion body 121 may be in line contact with the twisted hole 181 based on the cross-section of the protrusion 121*a*. The protrusion 121*a* as a whole may be in line contact with the twisted hole 181.

Referring to FIG. 17, although the protrusion 121*a* of the insertion body 121 of FIG. 17 is the same as the protrusion 121*a* of the insertion body 121 of FIG. 12, the protrusion 121*a* of the insertion body 121 may have a plurality of regularly-arranged concavo-convex portions 124. Thus, the protrusion 121*a* of the insertion body 121 may be in line or point contact with the twisted hole 181 up to a predetermined distance between the protrusion 121*a* and the support 122 and may be spaced apart from the support 122 from the predetermined distance to a free end of the protrusion 121*a* of the insertion body 121. That is, an end of the protrusion 121*a* of the insertion body 121 that is far away from the support 122, may be trimmed or tapered.

Alternatively, unlike in FIG. 17, the protrusion 121*a* of the insertion body 121 may be inclined from the support 122 to the free end, or may be inclined in a double manner so that a middle portion of the protrusion 121*a* of the insertion body 121 protrudes from the twisted hole 181. In this case, the protrusion 121*a* of the insertion body 121 may be in point contact with the twisted hole 181 based on the cross-section of the protrusion 121*a*. The protrusion 121*a* as a whole may be in point or line contact with the twisted hole 181.

Figure 18:
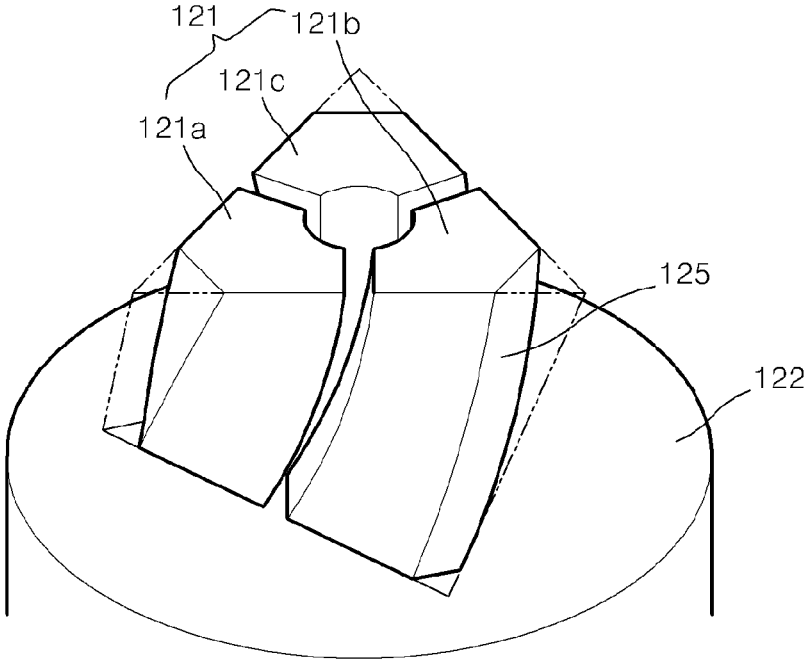
FIGS. 18 and 19 are perspective views of a driving assembly for a photosensitive drum, according to another embodiment of the present invention.
Figure 19:
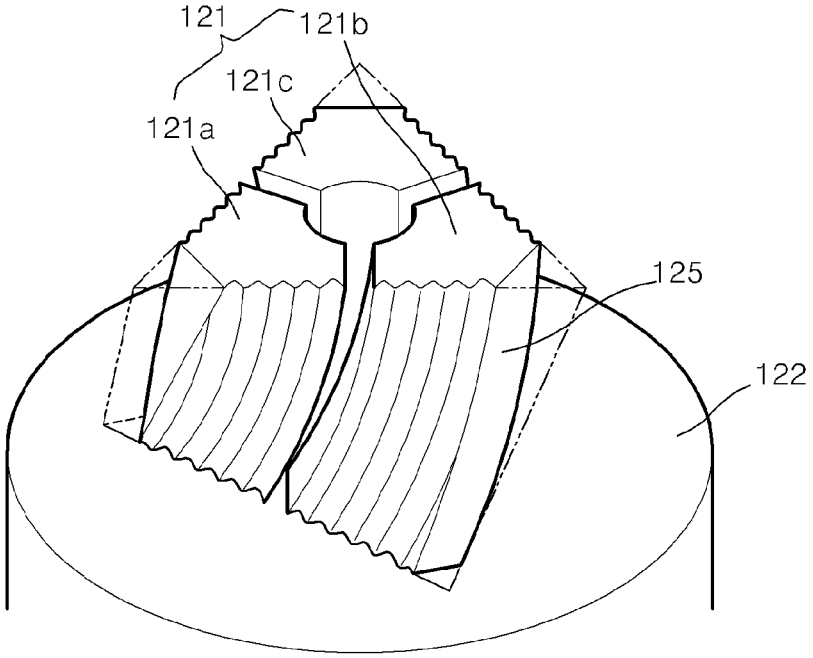
Figure 20:
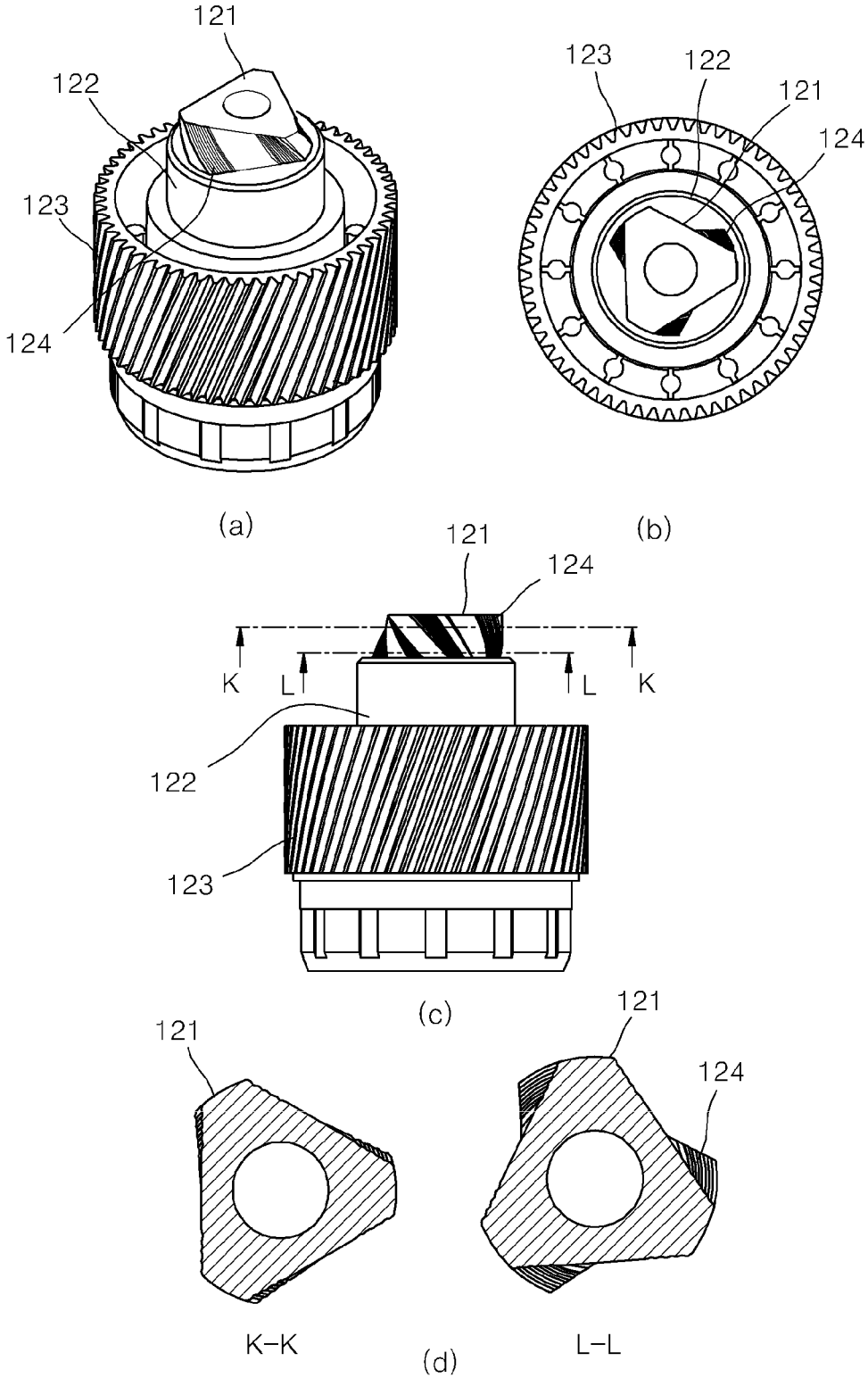
FIGS. 20A through 20D are a perspective view, a plan view, a side view, and a cross-sectional view of a driving assembly for a photosensitive drum, according to another embodiment of the present invention.
Figure 21:
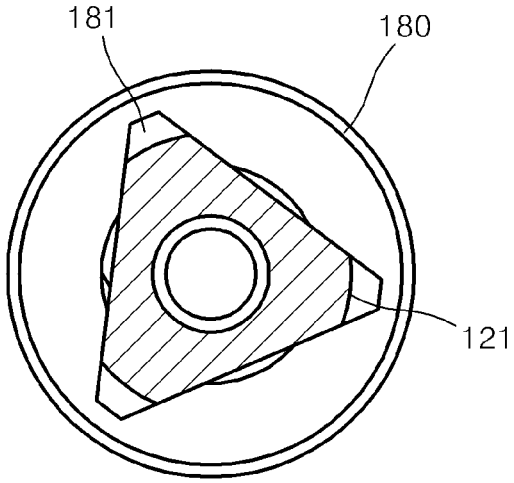
FIG. 21 is a view showing the case that an insertion body of the driving assembly for a photosensitive drum illustrated in FIGS. 20A through 20D and a twisted hole are combined with each other.
Figure 22:
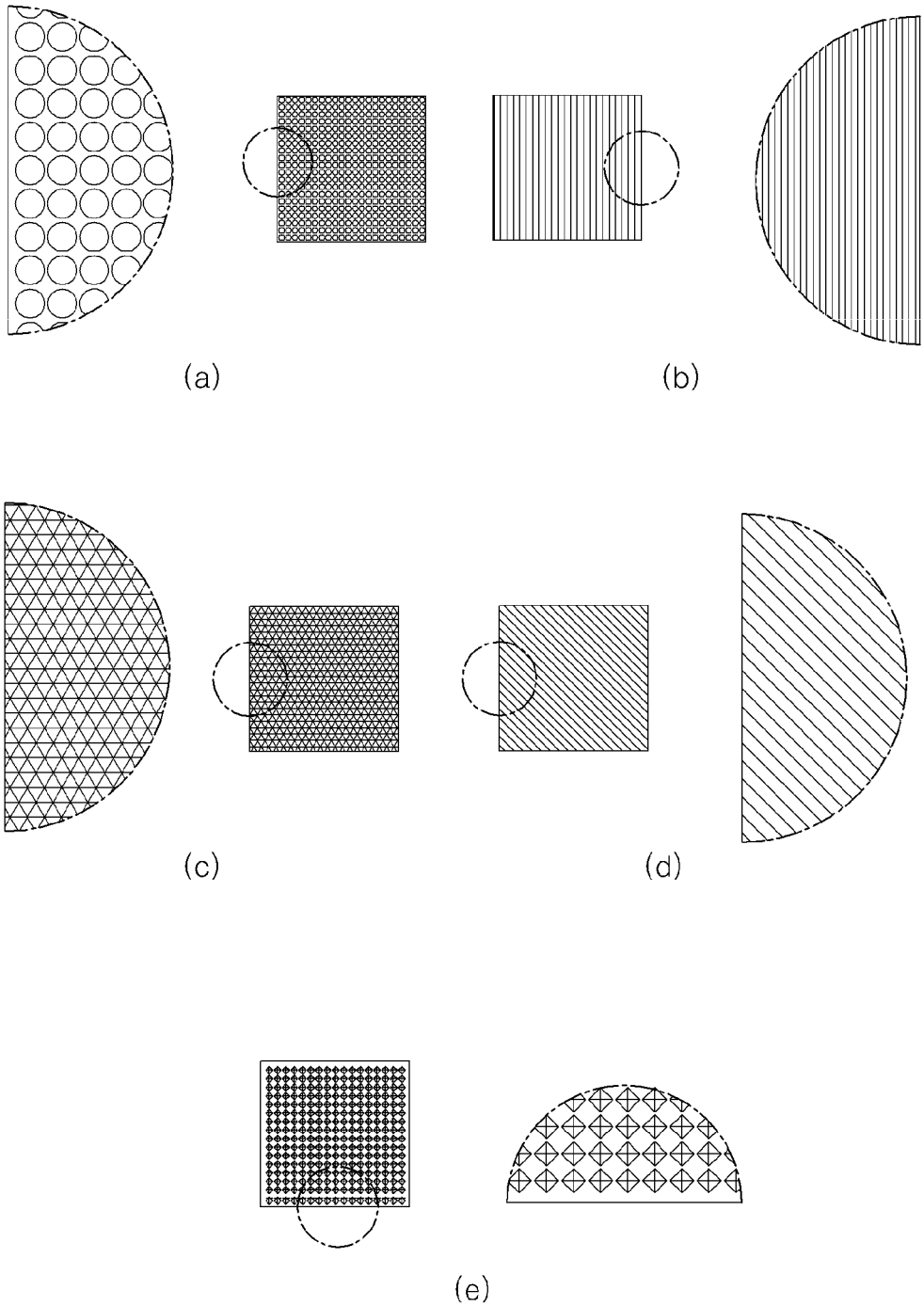
FIGS. 22A through 22E are views showing one surface of a driving assembly for a photosensitive drum, according to other embodiments of the present invention.

FIGS. 18 and 19 illustrate protrusions 121*a* of an insertion body 121 according to another embodiment of the present invention. FIGS. 18 and 19 are different from the above-described embodiments only in that the shape of the protrusions 121*a* of the insertion body 121 of FIGS. 18 and 19 is different from the shape of the protrusions 121*a* of the insertion body 121 in the above-described embodiments, and thus redundant descriptions thereof will be omitted.

Referring to FIG. 18, the length of contact between the protrusion 121*a* of the insertion body 121 and the twisted hole 181 based on a cross-section of the protrusion 121*a* of the insertion body 121 that is close to the support 122, may be larger than the length of contact between the protrusion 121*a* of the insertion body 121 and the twisted hole 181 based on a cross-section of the protrusion 121*a* of the insertion body 121 that is far away from the support 122.

For example, the length of contact between the protrusion 121*a* of the insertion body 121 and the twisted hole 181 based on a cross-section of the protrusion 121*a* of the insertion body 121 that is perpendicular to the driving shaft 180, may be decreased as the protrusion 121*a* of the insertion body 121 gets far away from the support 122. For example, the protrusion 121*a* of the insertion body 121 may include inclined surfaces 125 that connect side surfaces contacting the twisted hole 181. Due to the inclined surfaces 125 of the protrusion 121*a* of the insertion body 121, the contact length of the protrusion 121*a* of the insertion body 121 with the twisted hole 181 may be gradually decreased from the support 122 to an opposite end to the support 122, as illustrated in FIG. 18.

Thus, the area of contact between the protrusion 121*a* of the insertion body 121 and the twisted hole 181 may be decreased as the protrusion 121*a* gets far away from the support 122, and conversely, the area of contact between the protrusion 121*a* of the insertion body 121 and the twisted hole 181 may be increased as the protrusion 121*a* gets close to the support 122.

Furthermore, unlike in FIG. 18, the contact length of the protrusion 121*a* of the insertion body 121 with the twisted hole 181 may be uniform up to a predetermined distance between the protrusion 121*a* and the support 122 based on a cross-section of the protrusion 121*a*, and the contact length of the protrusion 121*a* of the insertion body 121 with the twisted hole 181 may be decreased from the predetermined distance to the opposite end to the support 122. For example, due to the inclined surfaces 125, the contact length of the protrusion 121*a* of the insertion body 121 with the twisted hole 181 may be uniform up to a predetermined distance between the protrusion 121*a* and the support 122 based on the cross-section of the protrusion 121*a*, and the contact length of the protrusion 121*a* of the insertion body 121 with the twisted hole 181 may be gradually decreased from the predetermined distance to the opposite end to the support 122.

Alternatively, unlike in FIG. 18, due to the inclined surfaces 125, the cross-section of the protrusion 121*a* of the insertion body 121 may be gradually decreased at a predetermined ratio up to a predetermined distance between the protrusion 121*a* and the support 122 and may be decreased at a larger ratio from the predetermined distance to the opposite end to the support 122.

Referring to FIG. 19, the point contact number of the protrusion 121*a* of the insertion body 121 with the twisted hole 181 based on a cross-section of the protrusion 121*a* that is close to the support 122, may be larger than the point contact number of the protrusion 121*a* of the insertion body 121 with the twisted hole 181 based on a cross-section of the protrusion 121*a* that is far away from the support 122.

For example, the point contact number of the protrusion 121*a* of the insertion body 121 with the twisted hole 181 based on a cross-section of the protrusion 121*a* that is perpendicular to the driving shaft 180, may be decreased as the protrusion 121*a* gets far away from the support 122. For example, the protrusion 121*a* of the insertion body 121 may include inclined surfaces 125 that connect side surfaces contacting the twisted hole 181. Due to the inclined surfaces 125, the point contact number of the protrusion 121*a* of the insertion body 121 with the twisted hole 181 may be gradually decreased from the support 122 to an opposite end to the support 122, as illustrated in FIG. 19.

Thus, the contact area of the protrusion 121*a* of the insertion body 121 with the twisted hole 181 may be decreased as the protrusion 121*a* gets far away from the support 122, and conversely, the contact area of the protrusion 121*a* of the insertion body 121 with the twisted hole 181 may be increased as the protrusion 121*a* gets close to the support 122.

Furthermore, unlike in FIG. 19, the point contact number of the protrusion 121*a* of the insertion body 121 with the twisted hole 181 based on a cross-section of the protrusion 121*a* may be the same up to a predetermined distance between the protrusion 121*a* and the support 122, and the point contact number of the protrusion 121*a* of the insertion body 121 with the twisted hole 181 based on the cross-section of the protrusion 121*a* may be decreased from the predetermined distance to the opposite end to the support 122. For example, due to the inclined surfaces 125, the point contact number of the protrusion 121*a* of the insertion body 121 based on the cross-section of the protrusion 121*a* may be the same up to a predetermined distance between the protrusion 121*a* and the support 122, and the point contact number of the protrusion 121*a* of the insertion body 121 based on the cross-section of the protrusion 121*a* may be gradually decreased from the predetermined distance to the opposite end to the support 122.

Alternatively, unlike in FIG. 19, due to the inclined surfaces 125, the point contact number of the protrusion 121*a* of the insertion body 121 may be gradually decreased at a predetermined ratio up to a predetermined distance between the protrusion 121*a* and the support 122, and the point contact number of the protrusion 121*a* of the insertion body 121 may be decreased at a larger ratio from the predetermined distance to the opposite end to the support 122.

In the above-described embodiments of FIGS. 12, 17, 18, and 19, the contact length of the protrusion 121*a* of the insertion body 121 with the twisted hole 181 may be decreased as the protrusion 121*a* gets far away from the support 122 so that the protrusion 121*a* may be more easily inserted in the twisted hole 181. In addition, the contact length of the protrusion 121*a* of the insertion body 121 with the twisted hole 181 may be increased as the protrusion 121*a* gets close to the support 122 so that a driving force may be well transmitted to the protrusion 121*a* when the twisted hole 181 is rotated and the danger of damage may be reduced.

The height of the protrusion 121*a* of the insertion body 121 according to the above-described embodiments may be the same or smaller than a depth of the twisted hole 181. If the height of the protrusion 121*a* of the insertion body 121 is larger than the depth of the twisted hole 181, the protrusion 121*a* of the insertion body 121 is not completely inserted in the twisted hole 181, and a gap is formed between the support 122 and the driving shaft 180 so that vibration and noise may occur when the twisted hole 181 rotated. However, if the height of the protrusion 121*a* of the insertion body 121 is the same as or smaller than the depth of the twisted hole 181, a gap is not formed between the support 122 and the driving shaft 180 so that vibration and noise may be prevented from occurring.

In addition, an end of the protrusion 121*a* of the insertion body 121 is tapered or trimmed and is smaller than the depth of the twisted hole 181 so that the protrusion 121*a* of the insertion body 121 may be easily attached to or detached from the driving shaft 180.

Although, in the above-described embodiments, the protrusions 121*a* of the insertion body 121 are all the same, but they may have different shapes or forms.

FIGS. 20A through 20D and FIG. 21 illustrate an insertion body 121 according to another embodiment of the present invention. The insertion body 121 illustrated in FIGS. 20A through 20D and FIG. 21 has a different shape from the shape of the insertion body 121 including a plurality of protrusions 121*a*, 121*b*, and 121*c*, and thus redundant descriptions thereof will be omitted.

The insertion body 121 in the above-described embodiments includes a plurality of protrusions 121*a*, 121*b*, and 121*c*; however, the insertion body 121 according to the present embodiment may include one protrusion. That is, the insertion body 121 may include one protrusion in which a plurality of protrusions are connected to one another.

The insertion body 121 may closely contact at least portions of side surfaces of the twisted hole 181, as in the above-described embodiments.

Regularly-arranged concavo-convex portions 124 may not be formed on side surfaces of the insertion body 121. However, as illustrated in FIGS. 20A through 20D and FIG. 21, the regularly-arranged concavo-convex portions 124 may be formed on the side surfaces of the insertion body 121. In addition, an end of the insertion body 121 may be trimmed or tapered.

When the twisted hole 181 includes curved surfaces, the insertion body 121 may not contact the curved surfaces of the twisted hole 181, as illustrated in FIGS. 20A through 20D and FIG. 21. However, unlike in FIGS. 20A through 20D and FIG. 21, the insertion body 121 has a complementary shape to the twisted hole 181 and thus may contact the curved surfaces of the twisted hole 181.

As described above, according to the one or more embodiments of the present invention, since a twisted protrusion of an insertion body closely contacts two side surfaces that constitute one of a plurality of corners of a twisted hole, the close contact state is maintained regardless of a driving force transmission state or a driving force non-transmission state. Thus, when the driving force non-transmission state is changed into the driving force transmission state, collision or friction does not occur in a contact portion between the twisted protrusion and the twisted hole so that abrasion and damage of the insertion body may be prevented.

In addition, a twisted contact surface of the insertion body and a twisted surface of the twisted hole are in surface contact with each other, and a cross-section of a base of the insertion body is larger than a cross-section of a front end of the insertion body so that a photosensitive drum assembly and a process cartridge having durability in which the image quality of the image forming apparatus may be maintained and having improved quality even in the case of long-term use may be implemented.

Furthermore, as inclined surfaces are formed along an ascending direction of the insertion body by removing portions of the twisted contact surface of the insertion body, a drive assembly of a photosensitive drum is smoothly inserted in a twisted triangular hole of a main body of the image forming apparatus without any noise and any shock so that a photosensitive drum assembly and a process cartridge having an improved structure in which an operation of mounting the photosensitive drum on the image forming apparatus may be more quietly performed and the durability of the image forming apparatus may be prevented from being lowered, may be implemented. Of course, the scope of the present invention is not limited by the effects.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A photosensitive drum assembly that is combinable with a driving shaft comprising a twisted hole with a non-circular cross-section having a plurality of corners, the photosensitive drum assembly comprising:

a support disposed at one side of the photosensitive drum; and an insertion body disposed at one side of the support and comprising a plurality of protrusions that are capable of being inserted in the twisted hole, wherein at least portions of each of the plurality of protrusions based on a cross-section of each protrusion that is perpendicular to the driving shaft, closely contacts two side surfaces of the twisted hole that constitute one of the plurality of corners of the twisted hole, respectively and wherein each protrusion comprises a plurality of regularly-arranged concavo-convex portions formed in portions corresponding to two side surfaces that constitute one of the plurality of corners of the twisted hole.

2. The photosensitive drum assembly of claim 1, wherein at least portions of each of the plurality of protrusions correspond to and are in surface contact with two side surfaces of the twisted hole that constitute one of the plurality of corners of the twisted hole, respectively.

3. The photosensitive drum assembly of claim 1, wherein each of the plurality of protrusions closely contacts two side surfaces of the twisted hole up to a predetermined distance between the protrusion and the support and is far away from two side surfaces of the twisted hole from the predetermined distance to a free end of the protrusion.

4. The photosensitive drum assembly of claim 1, wherein a length of contact between each protrusion and the twisted hole based on a cross-section of each protrusion that is perpendicular to the driving shaft, is decreased as the protrusion gets far away from the support.

5. The photosensitive drum assembly of claim 1, wherein a length of contact between each protrusion and the twisted hole based on a cross-section of each protrusion that is perpendicular to the driving shaft, is uniform up to a predetermined distance between the protrusion and the support and is decreased from the predetermined distance to a free end of the protrusion.

6. The photosensitive drum assembly of claim 1, wherein the insertion body is configured of the plurality of protrusions connected to one another.

7. The photosensitive drum assembly of claim 1, wherein the twisted hole further comprises curved surfaces formed by combining a non-circular cross-section having a plurality of corners and a circular cross-section, as well as two side surfaces, and the protrusion closely contacts at least portions of the curved surfaces of the twisted hole.

8. The photosensitive drum assembly of claim 1, wherein the plurality of regularly-arranged concavo-convex portions of each protrusion are continuously formed.

9. The photosensitive drum assembly of claim 1, wherein the plurality of regularly-arranged concavo-convex portions of each protrusion are formed in a direction in which the insertion body is inserted in the twisted hole.

10. The photosensitive drum assembly of claim 1, wherein each protrusion corresponds to two side surfaces of the twisted hole up to a predetermined distance between the protrusion and the support and is spaced apart from the support from the predetermined distance to a free end of the protrusion.

11. A process cartridge comprising a photosensitive drum assembly that is combinable with a driving shaft comprising a twisted hole with a non-circular cross-section having a plurality of corners, the process cartridge being combined with a main body of an image forming apparatus to be attachable to or detachable from the main body of the image forming apparatus, the process cartridge comprising:

a toner storing container in which toner is stored; and a photosensitive drum assembly to which the toner is supplied from the toner storing container and which prints an image on a recording medium, wherein the photosensitive drum assembly comprises:

a support disposed at one side of the photosensitive drum;

an insertion body disposed at one side of the support and comprising a plurality of protrusions that are capable of being inserted in the twisted hole, wherein at least portions of each of the plurality of protrusions based on a cross-section of each protrusion that is perpendicular to the driving shaft, closely contacts two side surfaces of the twisted hole that constitute one of the plurality of corners of the twisted hole, respectively; and wherein each protrusion comprises a plurality of regularly-arranged concavo-convext portions formed in portions corresponding to two side surfaces that constitute one of the plurality of corners of the twisted hole.

12. The process cartridge of claim 11, wherein at least portions of each of the plurality of protrusions correspond to and are in surface contact with two side surfaces of the twisted hole that constitute one of the plurality of corners of the twisted hole, respectively.

13. The process cartridge of claim 11, wherein each of the plurality of protrusions closely contacts two side surfaces of the twisted hole up to a predetermined distance between the protrusion and the support and is far away from two side surfaces of the twisted hole from the predetermined distance to a free end of the protrusion.

14. The process cartridge of claim 11, wherein a length of contact between each protrusion and the twisted hole based on a cross-section of each protrusion that is perpendicular to the driving shaft, is decreased as the protrusion gets far away from the support.

15. The process cartridge of claim 11, wherein a length of contact between each protrusion and the twisted hole based on a cross-section of each protrusion that is perpendicular to the driving shaft, is uniform up to a predetermined distance between the protrusion and the support and is decreased from the predetermined distance to a free end of the protrusion.

16. The process cartridge of claim 11, wherein the insertion body is configured of the plurality of protrusions connected to one another.

17. The process cartridge of claim 11, wherein the twisted hole further comprises curved surfaces formed by combining a non-circular cross-section having a plurality of corners and a circular cross-section, as well as two side surfaces, and the protrusion closely contacts at least portions of the curved surfaces of the twisted hole.

18. The process cartridge of claim 11, wherein the plurality of regularly-arranged concavo-convex portions of each protrusion are continuously formed.

19. The process cartridge of claim 11, wherein the plurality of regularly-arranged concavo-convex portions of each protrusion are formed in a direction in which the insertion body is inserted in the twisted hole.

20. The process cartridge of claim 11, wherein each protrusion corresponds to two side surfaces of the twisted hole up to a predetermined distance between the protrusion and the support and is spaced apart from the support from the predetermined distance to a free end of the protrusion.

* * * * *